US009812081B2

(12) United States Patent
Miyazawa et al.

(10) Patent No.: US 9,812,081 B2
(45) Date of Patent: Nov. 7, 2017

(54) LIQUID-CRYSTAL DISPLAY DEVICE AND METHOD FOR DRIVING SAME

(71) Applicant: Sharp Kabushiki Kaisha, Osaka-shi, Osaka (JP)

(72) Inventors: Jin Miyazawa, Osaka (JP); Kouji Kumada, Osaka (JP); Noriyuki Tanaka, Osaka (JP); Tatsuhiko Suyama, Osaka (JP); Takuya Sone, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 67 days.

(21) Appl. No.: 14/652,178

(22) PCT Filed: Dec. 20, 2013

(86) PCT No.: PCT/JP2013/084219

§ 371 (c)(1),
(2) Date: Jun. 15, 2015

(87) PCT Pub. No.: WO2014/103914

PCT Pub. Date: Jul. 3, 2014

(65) Prior Publication Data

US 2015/0332651 A1 Nov. 19, 2015

(30) Foreign Application Priority Data

Dec. 28, 2012 (JP) ..... 2012-288969

(51) Int. Cl.
*G09G 3/36* (2006.01)

(52) U.S. Cl.
CPC ..... *G09G 3/3648* (2013.01); *G09G 3/3614* (2013.01); *G09G 2310/0251* (2013.01);
(Continued)

(58) Field of Classification Search
CPC ..... G09G 3/3614; G09G 3/3648; G09G 2310/0251; G09G 2340/0435;
(Continued)

(56) References Cited

U.S. PATENT DOCUMENTS

2002/0180673 A1 12/2002 Tsuda et al.
2004/0095307 A1 5/2004 Kim
(Continued)

FOREIGN PATENT DOCUMENTS

JP 2001-312253 A 11/2001
JP 2004-170981 A 6/2004
(Continued)

OTHER PUBLICATIONS

Official Communication issued in International Patent Application No. PCT/JP2013/084219, dated Mar. 11, 2014.

*Primary Examiner* — Christopher E Leiby
(74) *Attorney, Agent, or Firm* — Keating & Bennett, LLP

(57) ABSTRACT

Based on a REF/NREF signal coming from a REF/NREF determination circuit, a polarity bias calculation circuit updates a polarity bias count value Nb indicating a degree of a polarity bias of an applied voltage to a liquid crystal layer, and based on this polarity bias count value Nb, a bias movement determination circuit determines a moving direction of the polarity bias. Upon receiving an OFF signal Soff instructing OFF of the power supply, a balance control circuit controls a drive unit based on a result of the determination of the polarity bias moving direction and on the polarity bias count value Nb at a point of time when the OFF signal Soff is inputted so that the polarity bias can be resolved before a power supply is turned off.

14 Claims, 10 Drawing Sheets

(52) U.S. Cl.
CPC ..... *G09G 2320/0204* (2013.01); *G09G 2320/046* (2013.01); *G09G 2330/027* (2013.01); *G09G 2340/0435* (2013.01)

(58) Field of Classification Search
CPC ..... G09G 2320/046; G09G 2320/0204; G09G 2330/027
See application file for complete search history.

(56) References Cited

U.S. PATENT DOCUMENTS

| | | | | |
|---|---|---|---|---|
| 2006/0274011 | A1 | 12/2006 | Igarashi et al. | |
| 2010/0051949 | A1* | 3/2010 | Yamazaki ..... | H01L 29/4908 257/57 |
| 2010/0073341 | A1* | 3/2010 | Toyooka ..... | G09G 3/3614 345/208 |
| 2011/0216052 | A1 | 9/2011 | Tanaka | |
| 2014/0015869 | A1 | 1/2014 | Takahashi et al. | |
| 2014/0028657 | A1 | 1/2014 | Kobayashi et al. | |

FOREIGN PATENT DOCUMENTS

| | | | |
|---|---|---|---|
| JP | 2010-197806 | A | 9/2010 |
| JP | 2011-059501 | A | 3/2011 |
| JP | 2011-085680 | A | 4/2011 |
| WO | 2005/081054 | A1 | 9/2005 |
| WO | 2012/137799 | A1 | 10/2012 |
| WO | 2012/141142 | A1 | 10/2012 |

* cited by examiner

LIQUID-CRYSTAL DISPLAY DEVICE AND METHOD FOR DRIVING SAME

TECHNICAL FIELD

The present invention relates to a liquid-crystal display device and a method for driving the same.

BACKGROUND ART

On a display unit of an active matrix-type liquid-crystal display device, a plurality of pixel formation portions are formed in a matrix. In each of the pixel formation portions, there are provided: a thin film transistor (hereinafter, referred to as a "TFT") that operates as a switching element; and a pixel capacitance connected to a data signal line through the TFT. By switching on/off this TFT, a data signal for displaying an image is written as a data voltage into the pixel capacitance in the pixel formation portion. This data voltage is applied to a liquid crystal layer of the pixel formation portion, and changes an orientation direction of liquid crystal molecules to a direction corresponding to a voltage value of the data signal. As described above, the liquid-crystal display device controls a transmittance of the liquid crystal layer of each pixel formation portion, and thereby displays an image on the display unit.

In a case where the liquid-crystal display device as described above is used in a portable electronic instrument or the like, a reduction of power consumption thereof has been heretofore required. Accordingly, there is proposed a method for driving a display device, in which a pause period (also referred to as a "non-refresh period") of turning all of gate lines as scanning signal lines of the liquid-crystal display device to a non-scanning state to pause refreshing of a display image after a scanning period (also referred to as a "refresh period") of performing the refreshing by scanning the gate lines (for example, refer to Unexamined Japanese Patent Publication No. 2001-312253). In this pause period, for example, controlling signals and the like can be prevented from being given to a gate driver as a scanning signal line drive circuit and/or a source driver as a data signal line drive circuit. In such a way, operations of the gate driver and/or the source driver can be paused, and accordingly, the power consumption can be reduced. As in such a driving method described in Unexamined Japanese Patent Publication No. 2001-312253, the drive performed by providing the pause period after the refresh period is referred to, for example, as "pause drive". Note that this pause drive is also referred to as "low frequency drive" or "intermittent drive". The pause drive as described above is suitable for still image display.

PRIOR ART DOCUMENT

Patent Document

[Patent Document 1] Japanese Patent Application Laid-Open No. 2001-312253

[Patent Document 2] Japanese Patent Application Laid-Open No. 2011-85680

SUMMARY OF THE INVENTION

Problems to be Solved by the Invention

In the liquid-crystal display device as descried above, if a power supply is turned off when the image is displayed on the display unit, the TFT in each pixel formation portion also turns to an OFF state. The data voltage held in the pixel capacitance in the pixel formation portion at this time is held also thereafter in a state of maintaining a value thereof. That is to say, after the power supply is turned off, a stored charge equivalent to the data voltage remains in the pixel capacitance. Therefore, an off-leak current (current flowing through the TFT in the OFF state) of the TFT is relatively large as in a case where a channel layer of the TFT in the pixel formation portion is composed of amorphous silicon (a-Si) or the like, the data voltage held in the pixel capacitance is discharged through the TFT to the data signal line in a short time after the power supply is turned off. However, in a case where the off-leak current of the TFT is small (for example, a case of a TFT using an oxide semiconductor such as indium gallium zinc oxide for the channel layer), a direct current voltage is applied thereto continuously, whereby there occurs such a problem (hereinafter, referred to as a "problem such as generation of flicker") that an afterimage formed by burn-in of liquid crystal is generated when the power supply is thereafter turned on, and that a flicker caused by deviation of an optimum common voltage is generated.

In order to address the above problem, there has been heretofore known a configuration in which voltages individually applied to a gate terminal, source terminal and common electrode of the TFT are controlled when the power supply of the liquid-crystal display device is turned off, whereby a voltage (stored charge in the pixel capacitance) held in the pixel capacitance in the pixel formation portion is discharged (hereinafter, this configuration is referred to as an "off-sequence configuration") (for example, refer to Unexamined Japanese Patent Publication No. 2011-85680).

However, the inventors of this application have found out that, in the liquid-crystal display device that performs the above-described pause drive, even in a case of adopting the off-sequence configuration for discharge in order to solve the problem such as the generation of the flicker, which is caused by the stored charge in the pixel capacitance after the power supply is turned off, the inventors have found out that the problem such as the generation of the flicker is not solved.

In this connection, it is an object of the present invention to provide a liquid-crystal display device, in which the problem such as the generation of the flicker does not occur even in the case of performing the pause drive, and to provide a method for driving the liquid-crystal display device.

Means for Solving the Problems

A first aspect of the present invention is directed to a liquid-crystal display device that displays an image represented by input image data, by applying a voltage corresponding to the input image data, to a liquid crystal layer in a display unit, the liquid-crystal display device comprising:

a drive unit configured to apply the voltage to the liquid crystal layer, the voltage corresponding to the input image data; and a display control unit configured to control the drive unit upon receiving an OFF signal instructing OFF of a power supply of the liquid-crystal display device, so that a polarity bias of the voltage applied to the liquid crystal layer is reduced from a time when the OFF signal is inputted until the power supply is turned off.

According to a second aspect of the present invention, in the first aspect of the invention, the display unit includes a plurality of pixel formation portions composed so as to hold the voltage to be applied to the liquid crystal layer, as a data voltage, and the display control unit includes:

a bias movement determination unit configured to determine whether the polarity bias is in an increasing direction or in a decreasing direction at a point of time when the OFF signal is inputted; and a balance control unit configured to control the drive unit in a case where the bias movement determination unit determines that the polarity bias is in the increasing direction, so that the polarity bias is reduced after performing polarity reverse refreshment of writing a data voltage into the plurality of pixel formation portions, the data voltage reversing the polarity of the applied voltage to the liquid crystal layer, and configured to control the drive unit in a case where the bias movement determination unit determines that the polarity bias is in the decreasing direction, so that the polarity bias is reduced without performing the polarity reverse refreshment.

According to a third aspect of the present invention, in the second aspect of the invention, the display control unit further includes a polarity bias calculation unit configured to obtain a degree of the polarity bias of the voltage applied to the liquid crystal layer, and the polarity bias calculation unit obtains a difference between a first number of frames and a second number of frames as a polarity bias count value indicating the degree of the polarity bias, the first number of frames being the number of frame periods while a data voltage with a same polarity as a polarity of a data voltage written into the pixel formation portions immediately after a point of time when the power supply of the liquid-crystal display device is turned on is held in the pixel formation portions, the second number of frames being the number of frame periods while a data voltage with a different polarity from the polarity of the data voltage written into the pixel formation portions immediately after the power supply is turned on is held in the pixel formation portions, and the bias movement determination unit determines whether the polarity bias is in the increasing direction or the decreasing direction based on comparison between the polarity bias count value at the point of time when the OFF signal is inputted and the polarity bias count value in a frame period before the point of time when the OFF signal is inputted.

According to a fourth aspect of the present invention, in the second aspect of the invention, the bias movement determination unit determines whether or not the polarity bias is in the increasing direction or the decreasing direction in response to whether the number of times of polarity reverse of the data voltage held in the pixel formation portions from the point of time when the power supply is turned on until the point of time when the OFF signal is inputted is an odd number or an even number.

According to a fifth aspect of the present invention, in the second aspect of the invention, before the point of time when the OFF signal is inputted, the balance control unit controls the drive unit so that the data voltage reversing the polarity of the applied voltage to the liquid crystal layer is written during a refresh period of writing the data voltage into the pixel formation portions, and the bias movement determination unit determines whether the polarity bias is in the increasing direction or the decreasing direction in response to whether a total number of frame periods included in the refresh period from the point of time when the power supply is turned on until the point of time when the OFF signal is inputted is an odd number or an even number.

According to a sixth aspect of the present invention, in anyone of the third to fifth aspects of the invention, the display control unit further includes a REF/NREF determination unit configured to determine, with regard to each frame period, whether the frame period is a refresh period of writing the data voltage into the plurality of pixel formation portions or a pause period of pausing the write of the data voltage into the plurality of pixel formation portions, and the balance control unit:

controls, before the point of time when the OFF signal is inputted, the drive unit so that the refresh period of writing the data voltage into the plurality of pixel formation portions and the pause period of pausing the write of the data voltage into the plurality of pixel formation portions appears alternately based on a result of the determination by the REF/NREF determination unit, and after the point of time when the OFF signal is inputted, in a case where the bias movement determination unit determines that the polarity bias is in the increasing direction, controls the drive unit so that the pause period for reducing the polarity bias is inserted in response to the degree of the polarity bias at the point of time when the OFF signal is inputted after the polarity reverse refreshment is performed, and in a case where the bias movement determination unit determines that the polarity bias is in the decreasing direction, controls the drive unit so that the pause period for reducing the polarity bias is inserted in response to the degree of the polarity bias at the point of time when the OFF signal is inputted without performing the polarity reverse refreshment.

According to a seventh aspect of the present invention, in the first aspect of the invention, the display control unit includes:

a polarity bias calculation unit configured to obtain a polarity bias of the voltage applied to the liquid crystal layer; and a balance control unit configured to, upon receiving the OFF signal, start a zero determination operation of continuously determining whether or not the polarity bias is substantially "0", maintain an operation of the drive unit without turning off the power supply while it is determined that the polarity bias is not "0" in the zero determination operation, and permit OFF of the power supply when the polarity bias is "0" in the zero determination operation.

According to an eighth aspect of the present invention, in the seventh aspect of the invention, wherein the display unit includes a plurality of pixel formation portions composed so as to hold a voltage to be applied to the liquid crystal layer, as a data voltage, the display control unit further includes a REF/NREF determination unit configured to determine, with regard to each frame period, whether the frame period is a refresh period of writing the data voltage into the plurality of pixel formation portions or a pause period of pausing the write of the data voltage into the plurality of pixel formation portions, and the balance control unit:

controls, before a point of time when the OFF signal is inputted, the drive unit so that the refresh period of writing the data voltage into the plurality of pixel formation portions and the pause period of pausing the write of the data voltage into the plurality of pixel formation portions appears alternately based on a result of the determination by the REF/NREF determination unit, and after the point of time when the OFF signal is inputted, continues an operation of the drive unit, the drive unit being performed before the point of time when the Off signal is inputted, while it is determined that the polarity bias is not "0" by the zero determination operation.

According to a ninth aspect of the present invention, in the sixth or eighth aspect of the invention, the REF/NREF determination unit detects presence of an image change by comparing image data for a previous frame period and image data for a subsequent frame with each other, and determines whether the subsequent frame period is the refresh period or the pause period in response to the presence of the image change.

According to a tenth aspect of the present invention, in the sixth or eighth aspect of the invention, the REF/NREF determination unit detects presence of an image change by comparing a result of predetermined arithmetic operation processing using image data for a previous frame period and a result of the arithmetic operation processing using image data for a subsequent frame with each other, and determines whether the subsequent frame period is the refresh period or the pause period in response to the presence of the image change.

According to an eleventh aspect of the present invention, in the sixth or eighth aspect of the invention, the REF/NREF determination unit determines, with regard to each frame period, whether the frame period is the refresh period or the pause period by input information given from an outside.

According to a twelfth aspect of the present invention, in the sixth or eighth aspect of the invention, in a period while the input image data is not given from an outside, the REF/NREF determination unit determines, with regard to each frame period, whether the frame period is the refresh period or the pause period so that the refresh period appears every predetermined time.

According to a thirteenth aspect of the present invention, in the second aspect of the invention, the liquid-crystal display device further including:

data signal lines and scanning signal lines configured to be connected to the pixel formation portions and the drive unit, wherein each of the pixel formation portions includes:

a pixel capacitance configured to hold the data voltage; and a switching element having a control terminal connected to the scanning signal line, a first conduction terminal connected to the data signal line, and a second conduction terminal connected to the pixel capacitance, wherein the switching element includes a thin film transistor having a channel layer formed of an oxide semiconductor.

According to a fourteenth aspect of the present invention, in the thirteenth aspect of the invention, the oxide semiconductor contains indium, gallium, zinc and oxygen.

A fifteenth aspect of the present invention is directed to a method for driving a liquid-crystal display device that displays, on a display unit, an image represented by input image data, by applying a voltage corresponding to the input image data, to a liquid crystal layer in the display unit, the method including:

a driving step of applying the voltage to the liquid crystal layer, the voltage corresponding to the input image data; and a polarity bias compensation step of, when an OFF signal instructing OFF of a power supply of the liquid-crystal display device is inputted, controlling voltage application to the liquid crystal layer so that a polarity bias of the voltage applied to the liquid crystal layer until a point of time when the OFF signal is inputted can be reduced from a time when the OFF signal is inputted until the power supply is turned off.

Effects of the Invention

In accordance with the first aspect of the present invention, when the OFF signal instructing OFF of the power supply is inputted, the drive unit is controlled so that the polarity bias of the voltage applied to the liquid crystal layer until the point of time when the OFF signal is inputted can be reduced. In such a way, at the point of time when the power supply is turned off, the polarity bias of the applied voltage to the liquid crystal layer is reduced, whereby the charge storage owing to the uneven distribution of the impurity ions in the liquid crystal layer is resolved or suppressed. As a result, the generation of the flicker, and the like, which are thereafter caused when the power supply is turned to operate the liquid-crystal display device, can be suppressed.

In accordance with the second aspect of the present invention, at the point of time when the OFF signal instructing OFF of the power supply is inputted, in the case where it is determined that the polarity bias of the applied voltage to the liquid crystal layer is in the increasing direction, the drive unit is controlled so that the polarity bias can be reduced after the polarity reverse refreshment is performed, and meanwhile, in the case where it is determined that the polarity bias is in the decreasing direction, the drive unit is controlled so that the polarity bias can be reduced without performing the polarity reverse refreshment. In such a way, irrespective of the moving direction of the polarity bias at the time when the OFF signal is inputted, the polarity bias can be reduced (canceled) in a short time by the voltage application to the liquid crystal layer after the point of time when the OFF signal is inputted.

In accordance with the third aspect of the present invention, based on the comparison between the polarity bias count value at the point of time when the OFF signal is inputted and the polarity bias count value in the frame period before the point of time when the OFF signal is inputted, it is determined whether the polarity bias of the applied voltage to the liquid crystal layer is in the increasing direction or the decreasing direction, and the drive unit is controlled based on the result of this determination in a similar way to the second aspect of the present invention. In such a way, similar effects to those of the second aspect of the present invention are obtained.

In accordance with the fourth aspect of the present invention, it is determined whether the polarity bias of the applied voltage to the liquid crystal layer is in the increasing direction or the decreasing direction in response to whether the number of times of the polarity reverse of the data voltage held in the pixel formation portions from the point of time when the power supply is turned on until the point of time when the OFF signal instructing OFF of the power supply is inputted is an odd number or an even number. In such a way, the determination of the moving direction of the polarity bias of the applied voltage to the liquid crystal layer can be performed with ease.

In accordance with the fifth aspect of the present invention, it is determined whether the polarity bias of the applied voltage to the liquid crystal layer is in the increasing direction or the decreasing direction in response to whether the total number of the frame periods included in the refresh period from the point of time when the power supply is turned on until the point of time when the OFF signal instructing OFF of the power supply is inputted is an odd number or an even number. In such a way, in the configuration in which the data voltage, which reverses the polarity of the applied voltage to the liquid crystal layer, is written during the refresh period, the determination of the moving direction of the polarity bias of the applied voltage to the liquid crystal layer can be performed with more ease.

In accordance with the sixth aspect of the present invention, in the liquid-crystal display device in which the pause drive is performed, when the OFF signal instructing OFF of the power supply is inputted to the liquid-crystal display device, after the point of time when the OFF signal is inputted, in the case where it is determined that the polarity bias of the applied voltage to the liquid crystal layer is in the increasing direction, the pause period for reducing the polarity bias is inserted after the polarity reverse refreshment is performed, and meanwhile, in the case where it is determined that the polarity bias is in the decreasing direction, the pause period is inserted without performing the polarity reverse refreshment. In the pause drive, the period while the polarity of the applied voltage to the liquid crystal layer is maintained to be the same is long, and accordingly, such a problem as the generation of the flicker, which is caused by the bias of the polarity, is prone to occur; however, in accordance with the sixth aspect of the present invention, also in the liquid-crystal display device that performs the pause period, such a polarity bias is canceled in a short time by the above-described operation performed after the point of time when the OFF signal is inputted, and the problem such as the generation of the flicker can be suppressed.

In accordance with the seventh aspect of the present invention, when the OFF signal instructing OFF of the power supply is inputted, the zero determination operation of continuously determining whether or not the polarity bias of the applied voltage to the liquid crystal layer is substantially "0" is started, and by this zero determination operation, the polarity bias can be reduced before the power supply is turned off without determining the moving direction of the polarity bias.

In accordance with the eighth aspect of the present invention, similar effects to those of the seventh aspect of the present invention are exerted in the liquid-crystal display device in which the pause drive is performed.

In accordance with the ninth aspect of the present invention, a slight change of the image is also detected, and based on a result of this detection, it can be determined whether the subsequent frame period is set to be the refresh period or the pause period.

In accordance with the tenth aspect of the present invention, without providing a memory with a large capacity, the presence of the image change is detected, and based on a result of this detection, it can be determined whether the subsequent frame period is set to be the refresh period or the pause period.

In accordance with the eleventh aspect of the present invention, without providing a memory and the like, it can be determined with ease whether each frame period is set to be the refresh period or the pause period.

In accordance with the twelfth aspect of the present invention, the refresh period is inserted every predetermined time also during the period while the input image data is not given from the outside. In such a way, quality of the image display is maintained, and the refreshment of reversing the polarity of the applied voltage to the liquid crystal layer is performed every predetermined time, whereby the charge storage owing to the uneven distribution of the impurity ions in the liquid crystal layer is suppressed, and a deterioration of the liquid crystal can be prevented.

In accordance with the thirteenth aspect of the present invention, the thin film transistor in which the channel layer is formed of the oxide semiconductor is used as the switching element of each pixel formation portion in the active matrix-type liquid-crystal display device. In such a way, the off-leak current of the thin film transistor is reduced to a large extent, and the voltage written into the pixel capacitance of each pixel formation portion is held for a longer period. Moreover, the polarity bias of the applied voltage to the liquid crystal layer can be canceled by the control for the drive unit after the point of time when the OFF signal instructing OFF of the power supply is inputted. Hence, in the case of performing the pause drive, the power consumption for the image display can be reduced to a large extent while the generation of the flicker, and the like are suppressed.

In accordance with the fourteenth aspect of the present invention, indium gallium zinc oxide is used as the oxide semiconductor that forms the channel layer of the thin film transistor included in each pixel formation portion, whereby similar effects to those of the thirteenth aspect of the present invention can be obtained.

Effects of other aspects of the present invention are obvious from the above-described first to fourteenth aspects of the present invention and from the following description of the embodiments, and accordingly, a description thereof is omitted.

MODES FOR CARRYING OUT THE INVENTION

A description is made below of embodiments of the present invention while focusing a liquid-crystal display device that performs pause drive; however, the present invention is also applicable to a liquid-crystal display device that does not perform the pause drive. Moreover, in the following description of the liquid-crystal display device that performs the pause drive, a frame period for writing a voltage of a data signal, which represents an image to be displayed, as a data voltage into a pixel formation portion is referred to as a "refresh frame period", and a frame period while the write of the data voltage is paused is referred to as a "pause frame period". Note that it is defined that "one frame period" is a period for refreshing one screen (that is, rewriting or writing the data voltage), and that a length of the "one frame period" is a length (16.67 ms) of one frame period in a general display device in which a refresh rate is 60 Hz; however, the present invention is not limited to this.

0. Basic Study

Before making the description of the embodiments of the present invention, a description is made of a basic study made by the inventors of this application in order to solve the problem described above.

Figure 1:
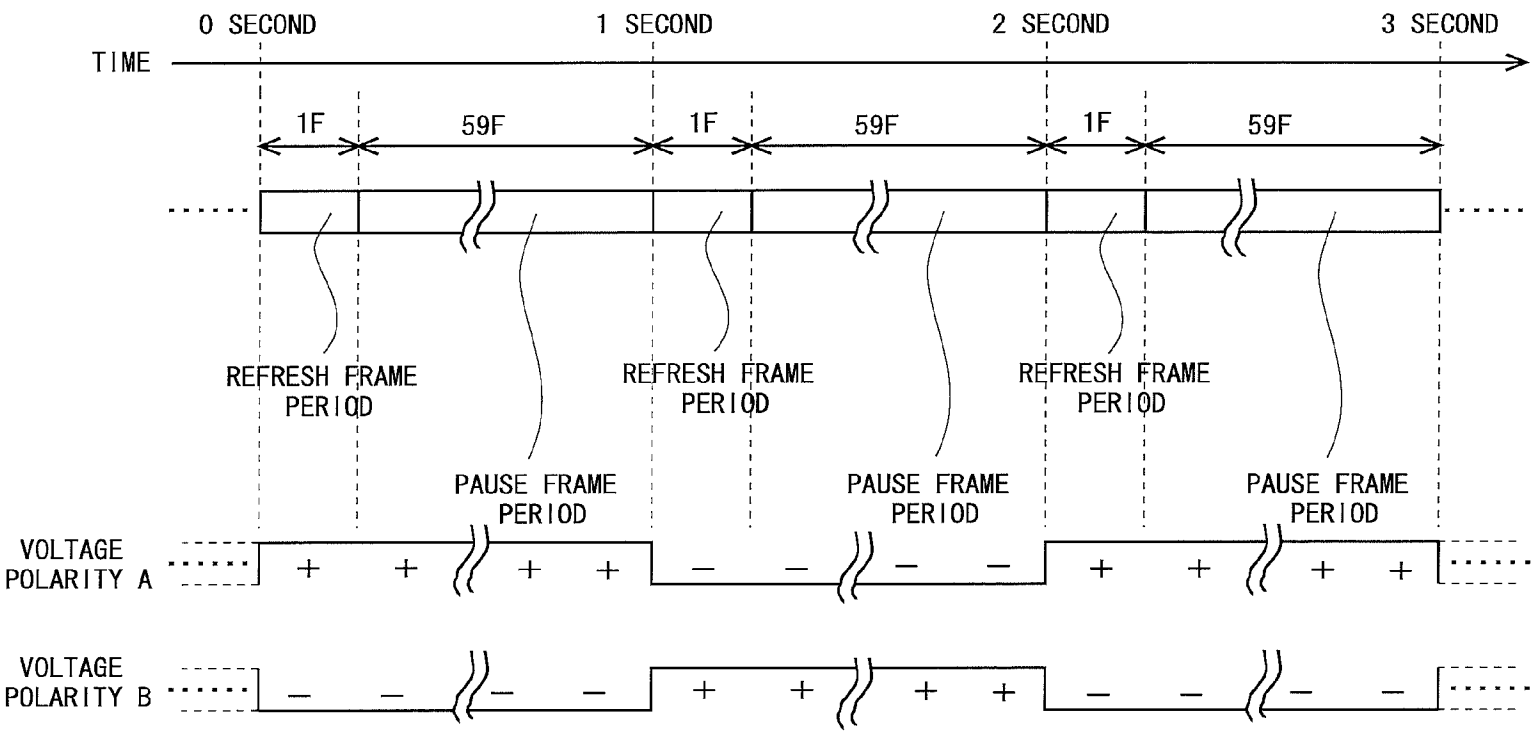
FIG. 1 is a timing chart for explaining an example of pause drive in a liquid-crystal display device.

FIG. 1 is a timing chart for explaining an example of the pause drive in the liquid-crystal display device. In this example, write of a data voltage by an amount of 1 screen is performed during 1 frame period, and during 59 frames which follow, the write of the data voltage is paused. That is to say, a display unit of the liquid-crystal display device is driven so that one refresh frame period and 59 pause frame periods can appear alternately. Hence, the refresh rate is 1 Hz, and a refresh cycle is 1 second. Moreover, in this example, a polarity of the data voltage, which is to be written into a pixel formation portion for each refresh frame period, is reversed. In FIG. 1, a voltage polarity A indicates a data voltage written into one pixel formation portion (that is, a polarity of a voltage held in a pixel capacitance of the pixel formation portion), and a voltage polarity B indicates a data voltage written into other pixel formation portion (into which a data voltage with a polarity different from the polarity of the data voltage written into the one pixel formation portion during the same frame period). As understood from the voltage polarities A and B shown in FIG. 1, in this example, the polarities (equivalent to polarities of an applied voltage to a liquid crystal layer of the liquid-crystal display device) of the data voltage held in the pixel capacitance in each pixel formation portion are reversed every one second, and an reverse cycle of the polarities of the applied voltage to the liquid crystal layer in this example (hereinafter, this reverse cycle is simply referred to as an "reverse cycle") is extremely long in comparison with such an reverse cycle (1 frame period=16.67 ms) in a usual liquid-crystal display device that does not perform the pause drive.

The liquid-crystal display device applies a voltage to the liquid crystal layer to control a transmittance of the liquid crystal layer, thereby displaying an image. However, if a direct current component is contained in the applied voltage to the liquid crystal layer, then charge storage owing to uneven distribution of impurity ions in the liquid crystal layer (hereinafter, the charge storage is simply referred to as a "charge bias") occurs, and as a result, a display defect such as a flicker and an afterimage is generated. Therefore, in general, alternating current drive is performed in the liquid-crystal display device. That is to say, the liquid-crystal display device is configured so that a temporal average value (or integrated value) of the applied voltage to the liquid crystal layer can be substantially "0" in such a manner that the polarities of the applied voltage to the liquid crystal layer are reversed every predetermined period (typically, every frame period) (refer to the voltage polarities A and B shown in FIG. 1).

However, depending on timing when the power supply of the liquid-crystal display device is turned off, the temporal average value of the applied voltage to the liquid crystal layer does not become "0", and the charge bias occurs in some case. For example, in the liquid-crystal display device in which the reverse cycle is 1 frame, when the power supply is turned off at a point of time when an odd number of frame periods elapse after the power supply is turned on, then the temporal integrated value of the applied voltage to the liquid crystal layer does not become "0", and an operation of the liquid-crystal display device is stopped in a state where the charge bias occurs. However, the charge bias at this time is no more than a bias caused by application of the voltage of one polarity between the positive and negative polarities during one frame period (16.67 ms), and accordingly, has not been recognized as a cause of the display defect such as the generation of the flicker.

In contrast, in the liquid-crystal display device that performs the pause drive as shown in FIG. 1, the reverse cycle is extremely long (1 second in the example in FIG. 1), and accordingly, it is frequent that the operation thereof is stopped in a state where the charge bias is large owing to OFF of the power supply. A description is made of this point with reference to FIG. 2. Note that, in the following, a point of time when the power supply is turned on is indicated by "t=0", a point of time when n seconds elapse after the power supply is turned on is indicated by "t=n", and a period from a point of time t=n1 to a point of time t=n2 is indicated by "t=n1 to n2".

Figure 2:
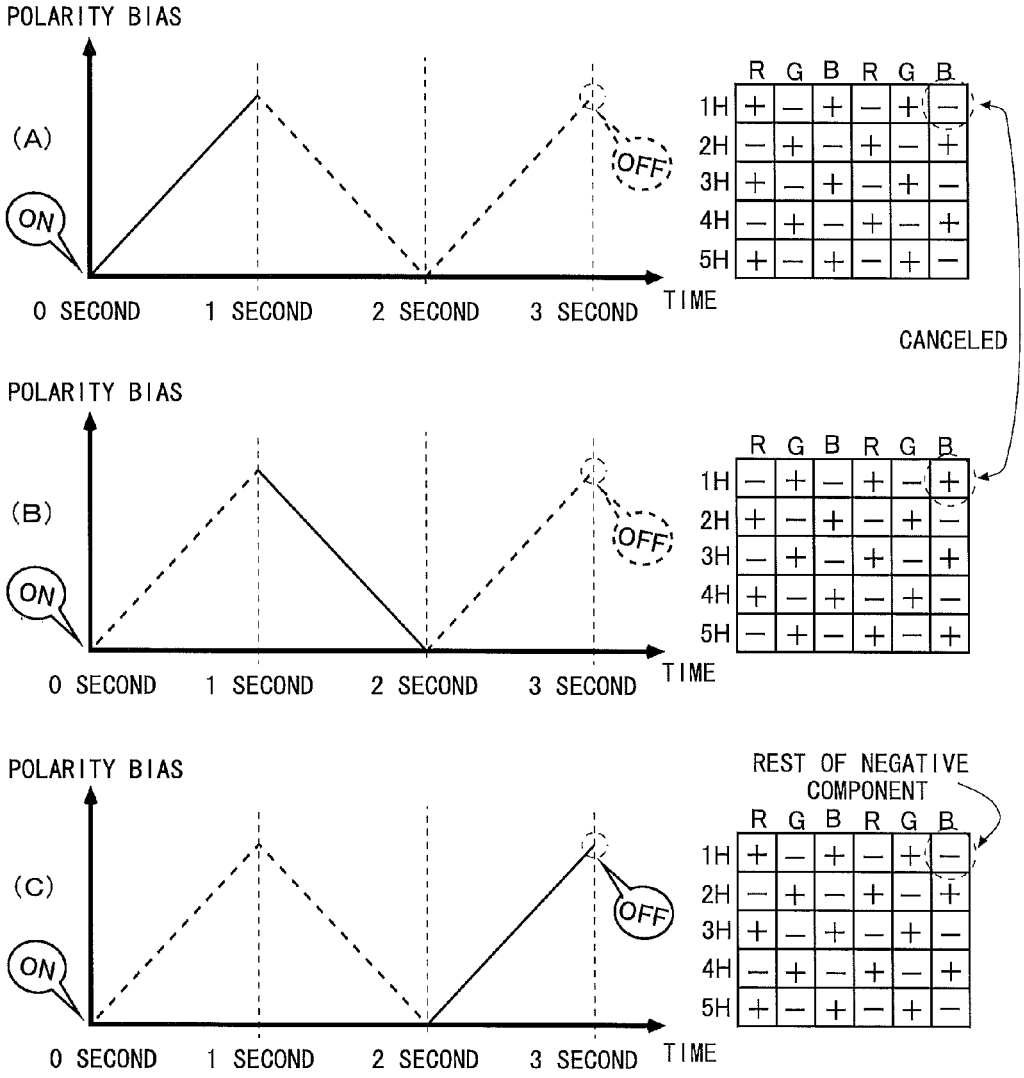
FIG. 2 are charts (A, B, C) for explaining a polarity bias when a power supply of the liquid-crystal display device that performs the pause drive is turned off.

FIG. 2 are charts for explaining a polarity bias when the power supply of the liquid-crystal display device that performs the pause drive is OFF. Here, the "polarity bias" refers to a difference between a total sum of a time while the positive data voltage is held in the same pixel formation portion and a total sum of a time while the negative data voltage is held in the same pixel formation portion, and is expressed below while taking 1 frame period as a unit; however, the present invention is not limited to this. This polarity bias is a difference between a total sum of the frame periods while the positive voltage is applied to the same position in the liquid crystal layer and a total sum of the frame periods while the negative voltage is applied to the same position, and if this difference is "0", then it can be said that there is no polarity bias. It can be thought that the above-described "charge bias" corresponds to this "polarity bias". Note that, in the example shown in FIG. 2, there is no polarity bias at the point of time when the power supply is turned on.

FIG. 2(A) shows a change of the polarity bias and a polarity pattern in a display unit of the liquid-crystal display device during a period from when the power supply is turned on until 1 second elapses, that is during a period of t=0 to 1. The change of the polarity bias is shown by a solid line in a graph on a left side in FIG. 2(A), and the polarity pattern is shown by a schematic view on a right side in FIG. 2(A) (the same also applies to FIG. 2(B) and FIG. 2(C)). In this example, when the power supply is turned on, a first 1 frame period becomes the refresh period, and 59 frame periods which follow become the pause period (refer to FIG. 1). During the 59 frame periods, the data voltage, which is written into each pixel formation portion during the refresh period immediately therebefore, is held approximately as it is. Hence, as shown in FIG. 2(A), during the period of t=0 to 1, the polarity bias is increased monotonously (linearly). Note that, for convenience of explanation, the polarity pattern shown in FIG. 2 is shown under conditions where the number of pixels in a vertical direction is 5 and the number of pixels in a horizontal direction is 6. Moreover, this polarity pattern is premised on a dot-reversal driving system; however, the present invention is not limited to this.

FIG. 2(B) shows a change of the polarity bias and a polarity pattern during a period of t=1 to 2. A first 1 frame period after the point of time t=21 (point of time when 1 seconds elapses after the power supply is turned on) becomes the refresh period, and by data write during this refresh period, the polarity of the applied voltage (data voltage held in each pixel formation portion) to the liquid crystal layer is reversed. 59 frame periods which follow become the pause period (refer to FIG. 1), and during the 59 frame periods, the data voltage written into each pixel formation portion immediately therebefore is held. Hence, as shown in FIG. 2(B), during the period of t=1 to 2, the polarity bias is decreased monotonously (linearly), and the polarity bias is resolved at the point of time t=2. That is to say, a total sum of a time while such a positive voltage is applied to the liquid crystal layer until the point of time t=2 and a total sum of a time while such a negative voltage is applied thereto until the point of time t=2 become the same. This stands for that the polarity bias generated during the period of t=0 to 1 is canceled by the polarity bias generated during the period of t=1 to 2.

FIG. 2(C) shows a change of the polarity bias and the polarity pattern during a period of t=2 to 3. A first 1 frame period after a point of time t=2 becomes the refresh period, and by write of the data voltage into each pixel formation portion during this refresh period, the polarity of the applied voltage to the liquid crystal layer is reversed. 59 frame periods which follow become the pause period (refer to FIG. 1). Hence, as shown in FIG. 2(C), during the period of t=2 to 3, the polarity bias is increased monotonously (linearly). Here, if the power supply is turned off at the point of time t=3, the operation of the liquid-crystal display device is stopped in the state where the polarity bias is large. Therefore, in the liquid-crystal display device, until the power supply is turned on next, there is brought a state where large charge storage owing to the uneven distribution of the impurity ions in the liquid crystal layer is left generated, that is, a state where a degree of the charge bias is large. As a result, there occurs such a problem that when the power supply is thereafter turned on, the afterimage occurs and the flicker is generated.

A problem such as the generation of the flicker is caused by the charge storage owing to the uneven distribution of the impurity ions in the liquid crystal layer, and it is conceived that the charge storage as described above occurs by the polarity bias of the applied voltage to the liquid crystal layer (hereinafter, this polarity bias is also simply referred to as "polarity bias"). The problem such as the generation of the flicker, which is caused by the charge storage owing to the uneven distribution of the impurity ions, cannot be solved even in a case of executing the conventional off-sequence for discharging the stored charge in the pixel capacitance.

A description is made below of embodiments of the present invention, which is made based on the basic study described above in order to solve the problem such as the generation of the flicker, which is caused by the polarity bias.

1. First Embodiment

1.1 Entire Configuration and Summary of Operations

Figure 3:
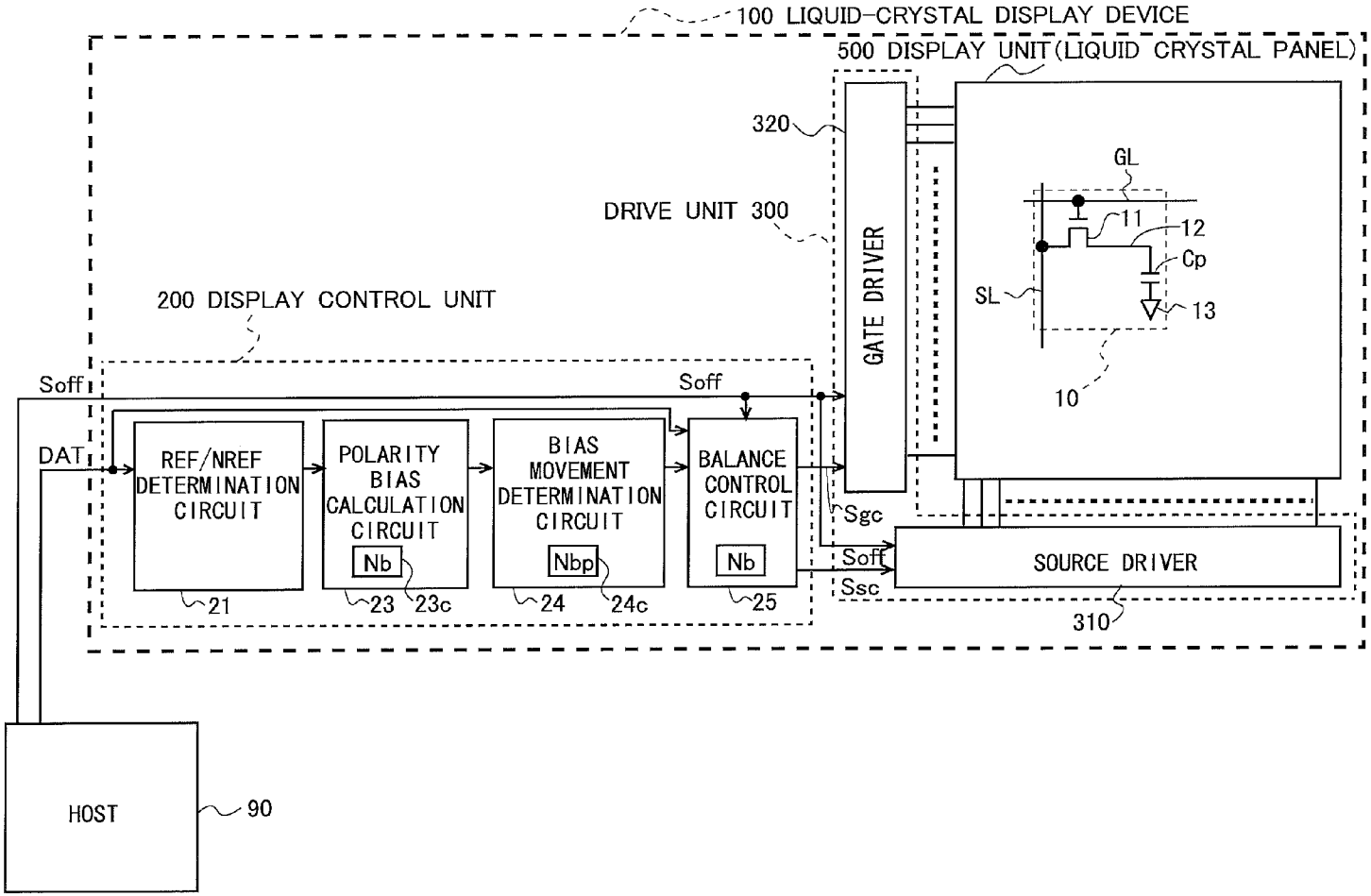
FIG. 3 is a block diagram showing an entire configuration of a liquid-crystal display device according to a first embodiment of the present invention.

FIG. 3 is a block diagram showing a configuration of a liquid-crystal display device 100 according to a first embodiment of the present invention. This liquid-crystal display device 100 includes: a display control unit 200; a drive unit 300; and a display unit 500. The drive unit 300 includes: a source driver 310 as a data signal line drive circuit; and a gate driver 320 as a scanning signal line drive circuit. The display unit 500 composes a liquid crystal panel, and this liquid crystal panel may have a configuration in which both or one of the source driver 310 and the gate driver 320 and the display unit 500 are formed integrally with each other. On an outside of the liquid-crystal display device 100, a host 90 mainly composed of a CPU (Central Processing Unit) is provided.

In the display unit 500, there are formed: a plurality of data signal lines SL; a plurality of scanning signal lines GL; and a plurality of pixel formation portions 10 arranged in a matrix so as to correspond to the plurality of data signal lines SL and the plurality of scanning signal lines GL. In FIG. 3, for convenience, there are shown: one pixel formation portion 10; and one data signal line SL and one scanning signal line GL, which correspond to the one pixel formation portion 10. Each pixel formation portion 10 includes: a thin film transistor (TFT) 11 as a switching element, in which a gate terminal is connected to the scanning signal line GL corresponding the pixel formation portion 10, and a source terminal is connected to the data signal line SL corresponding the pixel formation portion 10; a pixel electrode 12 connected to a drain terminal of the TFT 11; a common electrode 13 provided commonly to the above-described plurality of pixel formation portions 10; and a liquid crystal layer, which is sandwiched between the pixel electrode 12 and the common electrode 13, and is provided commonly to the above-described plurality of pixel formation portions 10. Then, a pixel capacitance Cp is composed of a liquid crystal capacitance formed of the pixel electrode 12 and the common electrode 13. Note that, typically, an auxiliary capacitance is provided in parallel to the liquid crystal capacitance in order to surely hold a voltage in the pixel capacitance Cp, and accordingly, in actual, the pixel capacitance Cp is composed of the liquid crystal capacitance and the auxiliary capacitance.

In this embodiment, as the TFT 11, for example, a TFT including a channel layer composed of an oxide semiconductor is used. More specifically, the channel layer of the TFT 11 is formed of In—Ga—Zn—O (indium gallium zinc oxide) containing indium (In), gallium (Ga), zinc (Zn) and oxygen (O). Hereinafter, the TFT including the channel layer composed of In—Ga—Zn—O is referred to as an "In—Ga—Zn—O TFT". An off-leak current of the In—Ga—Zn—O TFT is far small in comparison with a silicon-based TFT using amorphous silicon and the like for the channel layer. Therefore, the voltage written into the pixel capacitance Cp can be held for a longer period. Note that a similar effect is obtained even in a case of using, as the channel layer, an oxide semiconductor containing, for example, at least one of indium, gallium, zinc, copper (Cu), silicon (Si), tin (Sn), aluminum (Al), calcium (Ca), germanium (Ge) and lead (Pb) as an oxide semiconductor other than In—Ga—Zn—O. Moreover, such use of the oxide semiconductor as the channel layer of the TFT 11 is merely an example, and the silicon-based semiconductor may be used in place of this.

Typically, the display control unit 200 is realized as an IC (Integrated Circuit). The display control unit 200 receives data DAT, which includes input image data representing an image to be displayed, from the host 90, and in response to this, generates and outputs a source driver control signal Ssc, a gate driver control signal Sgc, a common voltage signal and the like. The source driver control signal Ssc is given to the source driver 310, the gate driver control signal is given to the gate driver 320, and the common voltage signal is given to the common electrode 13 in the display unit 500. Moreover, to the display control unit 200, an OFF signal Soff instructing OFF of the power supply of the liquid-crystal display device 100 is also inputted from the host 90, and this OFF signal Soff is also given to the source driver 310 and the gate driver 320 through the display control unit 200.

In response to the source driver control signal Ssc, the source driver 310 generates and outputs a data signal, which is to be given to each data signal line SL. For example, the source driver control signal Ssc includes: a digital video signal, which indicates the image to be displayed; a source start pulse signal; a source clock signal; a latch strobe signal; a polarity switch control signal; and the like. In response to the source driver control signal Ssc as described above, the source driver 310 operates a shift register, a sampling latch circuit and the like (not shown) in an inside thereof, converts a digital signal, which is obtained based on the digital video signal, into an analog signal by a DA conversion circuit (not shown), and thereby generates the above-described data signal.

In response to the gate driver control signal Sgc, the gate driver 320 repeats application of an active scanning signal to each scanning signal line GL in a predetermined cycle. For example, the gate driver control signal Sgc includes: a gate clock signal; and a gate start pulse signal. In response to the gate clock signal and the gate start pulse signal, the gate driver 320 generates a shift register and the like (not shown) in an inside thereof, and thereby generates the above-described scanning signal.

On a back surface side of the display unit 500, a backlight unit (not shown) is provided, whereby backlight light is applied onto a back surface of the display unit 500. The backlight unit may be a unit controlled by the display control unit 200, or may be a unit controlled by other methods. Note that, in a case where the liquid crystal panel is of a reflection type, it is not necessary to provide the backlight unit.

In such a manner as described above, the data signal is applied to each data signal line SL, the scanning signal is applied to each scanning signal line GL, whereby the image indicated by the input image data included in the data DAT transmitted from the host 90 is displayed on the display unit 500 in the liquid crystal panel.

1.2 Configuration of Display Control Circuit

As shown in FIG. 3, the display control unit 200 includes: a REF/NREF determination circuit 21; a polarity bias calculation circuit 23; a bias movement determination circuit 24; and a balance control circuit 25, and the data DAT and the OFF signal Soff, which are received from the host 90, are given to the REF/NREF determination circuit 21 and the balance control circuit 25.

Based on the data DAT received from the host 90, the REF/NREF determination circuit 21 determines whether or not each frame period is a refresh period (REF period) or a pause period (NREF period), generates a REF/NREF signal indicating a result of the determination, and gives the generated REF/NREF signal to the polarity bias calculation circuit 23. Moreover, this REF/NREF signal is also given to the bias movement determination circuit 24 and the balance control circuit 25 through the polarity bias calculation circuit 23. With regard to such a determination as to whether each frame period is the refresh period or the pause period, for example, in a case where the image represented by the input image data included in the data DAT received from the host 90 is changed from an image to be displayed during a previous frame period, then it can be determined that such a next frame is the refresh period. Moreover, if a period while the image represented by the input image data (hereinafter, this image is referred to as an "input image") is not changed or a period while the input image data is not received from the host 90 continues, the REF/NREF signal is generated so that the refresh frame period can be inserted every predetermined period. For example, in a case where the pause period continues for 59 frame periods, the REF/NREF signal is generated so that the next frame period can be the refresh period, that is, that the refresh period can be inserted at least once a second.

Methods for determining whether each frame period should be set to be the refresh period or the pause period are listed below. In this embodiment, any of a plurality of methods which will be described below can be used, or alternatively, a plurality of methods selected from the plurality of methods which will be described below may be used in combination with one another.

(1) Based on the input image data included in the data DAT received from the host 90, each of the frames is compared with a previous frame, and it is thereby determined whether or not the image is changed, and in response to a result of the determination, it is determined whether a next frame is the refresh period or the pause period.

(2) Predetermined arithmetic operation processing is performed for each frame by using the input image data included in the data DAT received from the host 90, a result of such an arithmetic operation for each frame is compared with a result of an arithmetic operation for the previous frame, it is determined whether the image is changed, and in response to a result of the determination, it is determined whether the next frame is the refresh period or the pause period. As the predetermined arithmetic operation, there are conceived: calculation of a sum total of pixel values in 1 frame; calculation of a checksum therein; and the like.

(3) With regard to each frame period, a dedicated signal indicating whether the frame period is the refresh period or the pause period is received from the host 90.

(4) With regard to each frame period, the host 90 writes the data, which indicates whether the frame period is the refresh period or the pause period, into a specific register provided in the display control unit 200.

(5) In a case where data of the input image is included in the data DAT received from the host 90, it is next determined that the frame period is the refresh period, and in a case where the data of the input image is not included in the data DAT, it is next determined that the frame period is the pause period.

(6) With regard to each frame period, it is determined whether the frame period is the refresh period or the pause period so that such refreshment can be performed periodically (every predetermined time) in the case where the data of the input image is not included in the data DAT received from the host 90.

With regard to cases of using the methods of (1) and (2) among the above-described methods of (1) to (6), configurations thereof will be described later.

The polarity bias calculation circuit 23 includes a register 23*c* for storing a value, which indicates a degree of the polarity bias at the present point of time. Hereinafter, this register is referred to as a "polarity bias counter 23*c*", and a value of this polarity bias counter 23*c* is denoted by reference symbol "Nb". In an initial state, the polarity bias calculation circuit 23 sets this polarity bias count value Nb at "0", increments the value Nb by "1" (increases the value Nb by "1") at a point of ending time of a first refresh frame period after the power supply is turned on, and thereafter, increments the value Nb by "1" every time when 1 pause frame period is ended until a next refresh frame period appears. That is to say, the polarity bias count value Nb is subjected to a counting-up operation every frame period. Note that, in this embodiment, it is assumed that there is no polarity bias at the point of time when the power supply is turned on.

In this embodiment, during the refresh frame period, (the balance control circuit 25 of) the display control unit 200 reverses the polarity of the data voltage, which is held in (the pixel capacitance Cp of) each pixel formation portion 10, without fail. Hence, the polarity bias calculation circuit 23 decrements the value Nb by "1" (decreases the value Nb by "1") at a point of time when the next refresh frame period is ended, and thereafter, decrements the value Nb by "1" every time when one pause frame period is ended until the next refresh frame period appears. That is to say, the polarity bias count value Nb is subjected to a counting-down operation every frame period. Subsequently, every time when the refresh frame period appears, the polarity bias calculation circuit 23 performs alternate switching between the counting-up operation and the counting-down operation (hereinafter, this switching is referred to as "switching of a counting direction") for the polarity bias count value Nb. As a result, in a case where the refreshment is performed an odd number of times from the point of time when the power supply is turned on until the present point of time, at the present point of time and after, the polarity bias count value Nb is incremented by "1" every time when one frame period is ended, and in a case where the refreshment is performed an even number of times from the point of time when the power supply is turned on until the present point of time, the polarity bias count value Nb is decremented by "1" every time when one frame period is ended.

As described above, in the polarity bias counter 23*c*, as the polarity bias count value Nb indicating the degree of the polarity bias of the applied voltage to the liquid crystal layer, such a difference as follows is held, the difference being between a first number of frames, which is the number of the frame periods while the data voltage with the same polarity as the polarity of the data voltage written into the pixel formation portion 10 immediately after the power supply of the liquid-crystal display device 100 is turned on is held in the pixel formation portion, and a second number of frames, which is the number of the frame periods while the data voltage with a different polarity from the polarity of the data voltage written into the pixel formation portion 10 immediately after the power supply of the liquid-crystal display device 100 is turned on is held in the pixel formation portion. This polarity bias count value Nb is outputted as a signal from the polarity bias calculation circuit 23, is given to the bias movement determination circuit 24, and is also given to the balance control circuit 25 through the bias movement determination circuit 24.

Based on the polarity bias count value Nb given from the polarity bias calculation circuit 23, the bias movement determination circuit 24 determines whether the polarity bias of the applied voltage to the liquid crystal layer is in an increasing direction or a decreasing direction, that is, determines a moving direction of the polarity bias. As a method for determining the moving direction of the polarity bias, for example, one of the following methods of (A1) and (A2) can be used, or these two methods of (A1) and (A2) may be used in combination with each other.

(A1) A polarity bias count value Nb (hereinafter, referred to as an "immediately previous refreshing polarity bias count value Nbp") at a point of time when the immediately previous refresh frame period is started is held in advance in an immediately previous refreshing polarity bias counter 24*c* that is a register provided in the bias movement determination circuit 24. Then, the polarity bias count value Nb at the present point of time, which is given from the polarity bias calculation circuit 23, is compared with the immediately previous refreshing polarity bias count value Nbp, and in response to a result of the comparison, it is determined whether the polarity bias is in the increasing direction or the decreasing direction.

(A2) Such polarity bias count values Nb at points of time when a plurality of immediately previous frame periods are ended are stored in advance in the bias movement determination circuit 24, and an average value Nba of these polarity bias count values Nb is obtained. The polarity bias count value Nb at the present point of time, which is given from the polarity bias calculation circuit 23, is compared with the average value Nba, and in response to a result of the comparison, it is determined whether the polarity bias is in the increasing direction or the decreasing direction. Note that, in place of the above-described average value Nba, another value (for example, a median value), which can be regarded to represent the polarity bias count values Nb at the respective points of time when the above-described plurality of immediately previous frame periods are ended, may be used.

The following description is made on the assumption that the above-described (A1) is used as the method for determining the moving direction of the polarity bias in this embodiment. The determination result in the bias movement determination circuit 24 is given as a bias moving direction signal to the balance control circuit 25.

After the power supply is turned on, the balance control circuit 25 controls the source driver 310 and the gate driver 320 based on the data DAT received from the host 90 and on the above-described REF/NREF signal until receiving the OFF signal Soff, which instructs OFF of the power supply, from the host 90 (until the OFF signal Soff becomes active). In such a way, the display unit 500 is driven by the source driver 310 and the gate driver 320 so that the image represented by the input image data included in the data DAT can be displayed on the display unit 500. As already mentioned, the pause drive system is adopted in this embodiment. Therefore, in this drive, based on the above-described REF/NREF signal, the refreshment, which rewrites the data voltage held in each pixel formation portion 10 based on the input image data so that the polarity of the data voltage can be reversed, is performed during the refresh frame period, and the refreshment is paused by turning all of the scanning signal lines GL to a non-selected state during the pause frame period. For example, in a case where forced refreshment that is based on new input image data received from the host 90 during the pause period is not performed, the refreshment is performed every predetermined period (hereinafter, this refreshment is referred to as "periodical refreshment"), and the drive as shown in FIG. 1 is performed.

Upon having received the OFF signal Soff, which instructs OFF of the power supply, from the host 90, the balance control circuit 25 controls the drive unit 300, which is composed of the source driver 310 and the gate driver 320, so that the above-described polarity bias count value Nb at a power supply OFF instructing point of time, which is a point of time when the OFF signal Soff is inputted, can be sequentially decreased and become "0" after the power supply OFF instructing point of time. In such a way, the balance control circuit 25 controls the application of the voltage to the liquid crystal layer. Specifically, the balance control circuit 25 executes the following (Step B1 to (Step B3).

(Step B1): First, based on the above-described bias moving direction signal, it is determined whether the polarity bias is in the increasing direction or in the decreasing direction. As a result, in a case where it is determined that the polarity bias is in the increasing direction, the drive unit 300 is controlled so that the refreshment that reverses the polarity of the data voltage held in each pixel formation portion 10 can be performed, whereby one refresh frame period is inserted. The polarity bias count value Nb received from the polarity bias calculation circuit 23 is decremented by 1, and thereafter, the processing proceeds to Step B2. Meanwhile, in a case where it is determined that the polarity bias is in the decreasing direction, the processing proceeds to Step B2 without performing the refreshment.

(Step B2): Such an operation of "controlling the drive unit 300 so that the pause frame period can be inserted sequentially, and decrementing the above-described polarity bias count value Nb by "1" every time when one pause frame period is ended" is repeated until the above-described polarity bias count value Nb can become "0", and the processing proceeds to Step B3 when the above-described polarity bias count value Nb becomes "0".

(Step B3): The drive unit 300 is controlled so that the "off-sequence for discharge" can be executed.

After the off-sequence for discharge in Step B3 described above is ended, the power supply of the liquid-crystal display device 100 according to this embodiment is turned off. By such OFF of the power supply, the polarity bias count value Nb in the polarity bias calculation circuit 23 is initialized to "0", and the immediately previous refreshing polarity bias count value Nbp in the bias movement determination circuit 24 is also initialized to "0". Note that the "off-sequence for discharge" in Step B3 described above is a sequence for discharging charges stored in the pixel capacitance Cp in each pixel formation portion 10, and a specific configuration thereof is not particularly limited; however, an off-sequence similar to the conventional off-sequence for discharge may be used.

1.3 First and Second Operation Examples

Figure 4:
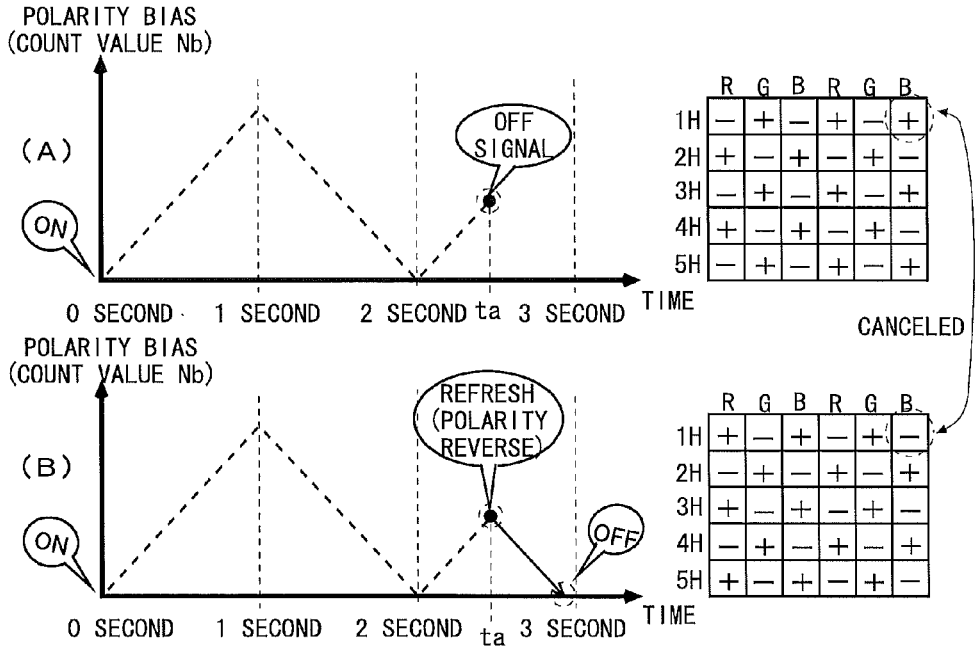
FIG. 4 are charts (A, B) for explaining a first operation example in the above-described first embodiment.

FIG. 4 are charts for explaining a first operation example in the above-described first embodiment. It is assumed that pause drive as shown in FIG. 1 mentioned above is performed in this first operation example. That is to say, the periodical refreshment is performed once a second with the forced refreshment being not inserted, and every time when the refreshment is performed, the polarity of the data voltage held in each pixel formation portion 10 is reversed. Note that an expression method in FIG. 4 is similar to an expression method in FIG. 2 mentioned above.

In this first operation example, in a similar way to the example shown in FIG. 2, the above-described polarity bias count value Nb is changed as shown by a dotted line in FIG. 4(A), and at a point of time ta included in the period of t=2 to 3, the OFF signal Soff instructing OFF of the power supply is inputted from the host 90.

At the power supply OFF instructing point of time ta, the above-described polarity bias count value Nb is larger than the immediately previous refreshing polarity bias count value Nbp (polarity bias count value Nb at the point of time t=2). Therefore, it is determined that the polarity bias is in the increasing direction. As a result, as shown in FIG. 4(B), at the power supply OFF instructing point of time ta, the refresh frame period is started (refer to Step B1). The polarity of the data voltage held in each pixel formation portion 10 is reversed in this refresh frame period.

Thereafter, the insertion of the pause frame period is repeated, and as shown by a solid line in FIG. 4(B), the polarity bias count value Nb is decremented by "1" every time when one pause frame period is ended (refer to Step B2). As a result of such an operation, the insertion of the pause frame period is discontinued at the point of time when the polarity bias count value Nb becomes "0". At this discontinuation point of time, the polarity bias at the power supply OFF instructing point of time ta is canceled by the polarity bias generated after this point of time ta.

The off-sequence for discharge is started at the point of time when the polarity bias is canceled as described above (that is, the point of time when the insertion of the pause frame period is discontinued) (refer to Steps B2 and B3). When this off-sequence is ended, the power supply of the liquid-crystal display device 100 is turned off.

Figure 5:
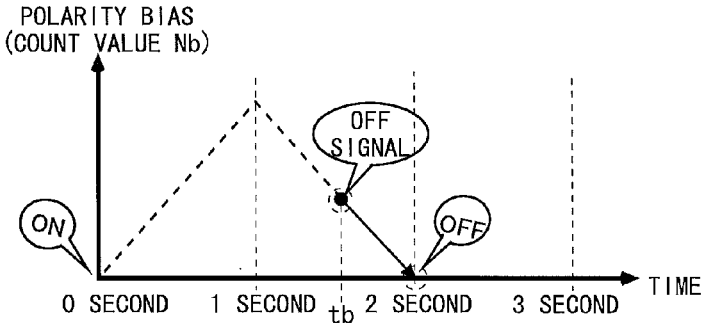
FIG. 5 is a timing chart showing a second operation example in the above-described first embodiment.

FIG. 5 is a timing chart showing a second operation example in this embodiment. Also in this operation example, in a similar way to the first operation example, the periodical refreshment is performed once a second with the forced refreshment being not inserted, and every time when the refreshment is performed, the polarity of the data voltage held in each pixel formation portion 10 is reversed (refer to FIG. 1 and FIG. 4). However, while the point of time (power supply OFF instructing point of time) when the OFF signal Soff instructing OFF of the power supply is inputted is the point of time to in the period of t=2 to 3 in the first operation example, a power supply OFF instructing point of time in this operation example is a point of time tb in the period of t=1 to 2 as shown in FIG. 5.

At this power supply OFF instructing point of time tb, the above-described polarity bias count value Nb is smaller than the immediately previous refreshing polarity bias count value Nbp (polarity bias count value Nb at the point of time t=1). Therefore, it is determined that the polarity bias is in the decreasing direction. As a result, if the OFF signal Soff instructing OFF of the power supply is inputted at the point of time tb, the insertion of the pause frame period is repeated with the refresh frame period being not inserted, and as shown by a solid line in FIG. 5, the polarity bias count value Nb is decremented by "1" every time when one pause frame period is ended (refer to Step B2). As a result of such an operation, the insertion of the pause frame period is discontinued at the point of time when the polarity bias count value Nb becomes "0". At such a discontinuation point of time, a state where the polarity bias is resolved (degree of polarity bias is "0") is brought.

When the polarity bias is resolved as described above, the off-sequence for discharge is started (refer to Steps B2 and B3). When this off-sequence is ended, the power supply of the liquid-crystal display device 100 is turned off.

1.4 Third to Fifth Operation Examples

A description is made below of third to fifth operation examples in this embodiment with reference to FIG. 6 to FIG. 9. In these third to fifth operation examples, in addition to the fact that the periodical refreshment is performed in a cycle of 1 second after the power supply is turned on in a similar way to the first operation example, the forced refreshment is also performed, and timing of the periodical refreshment and timing of the forced refreshment are common to the third to fifth operation examples; however, such an input point of time (power supply OFF instructing point of time) of the OFF signal Soff instructing OFF of the power supply differs depending on the operation examples. Frame periods other than the refresh frame periods while the periodical refreshment and the forced refreshment are performed are the pause frame periods.

Figure 6:
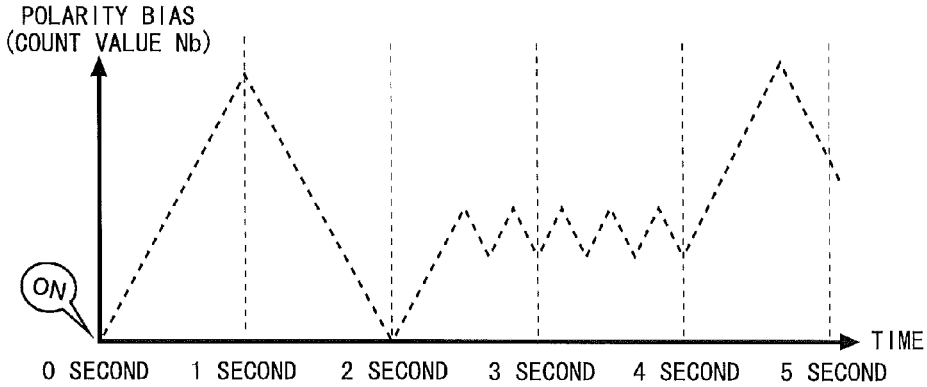
FIG. 6 is timing chart for explaining third to fifth operation examples in the above-described first embodiment.

FIG. 6 shows a change of the polarity bias count value Nb in a case where it is assumed that the OFF signal Soff instructing OFF of the power supply is not inputted until a point of time when 5 seconds elapse after the power supply is turned on (that is, during a period of t=0 to 5) in the third to fifth operation examples described below. In this operation example shown in FIG. 6, the forced refreshment is performed three times during the period of t=2 to 3, the forced refreshment is performed five times during the period of t=3 to 4, and the forced refreshment is performed once during the period of t=4 to 5. Note that, in both of the periodical refreshment and the forced refreshment, the polarity of the data voltage held in each pixel formation portion 10 is reversed. That is to say, every time when the refresh frame period appears, the moving direction of the polarity bias is switched, and the counting direction is also switched.

Figure 7:
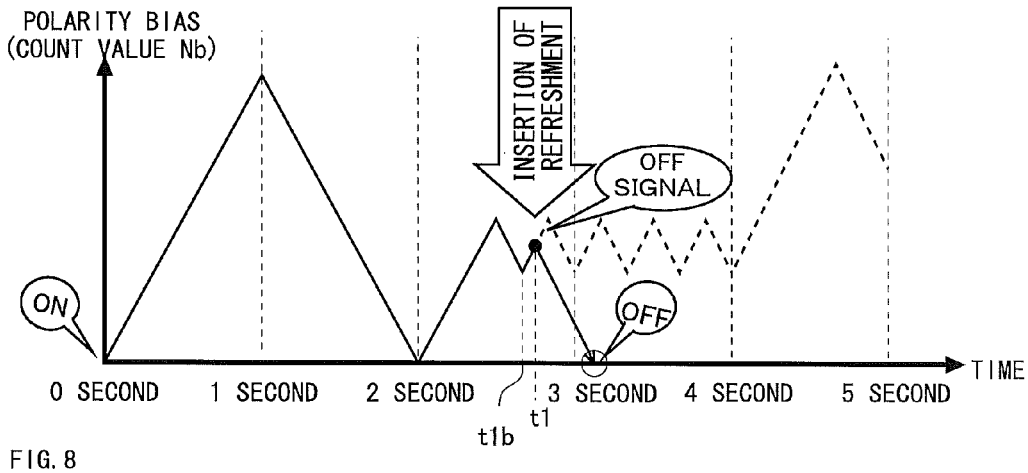
FIG. 7 is a timing chart showing a third operation example in the above-described first embodiment.

FIG. 7 is a timing chart showing the third operation example in this embodiment. In this operation example, first refreshment (write of the data voltage into each pixel formation portion 10) is performed immediately after the power supply is turned on, and the periodical refreshment is performed at the point of time t=1 and the point of time t=2. Thereafter, the forced refreshment is performed twice during the period of t=2 to 3, and the OFF signal Soff instructing OFF of the power supply is inputted from the host 90 at the point of time t1.

Here, such a starting point of time of the refresh frame period, which is immediately before this power supply OFF instructing point of time t1, is a starting point of time t1*b* of the frame period while the forced refreshment is performed, and a polarity bias count value Nb at this point of time t1*b* is held as the immediately previous refreshing polarity bias count value Nbp in the immediately previous refreshing polarity bias counter 24*c* in the bias movement determination circuit 24. As shown in FIG. 7, the polarity bias count value Nb at the power supply OFF instructing point of time t1 is larger than this immediately previous refreshing polarity bias count value Nbp. Therefore, it is determined that the polarity bias is in the increasing direction at the power supply OFF instructing point of time t1. As a result, at the power supply OFF instructing point of time t1, the refresh frame period is started (refer to Step B1). The polarity of the data voltage held in each pixel formation portion 10 is reversed in this refresh frame period.

Thereafter, the insertion of the pause frame period is repeated, and the polarity bias count value Nb is decremented by "1" every time when one pause frame period is ended (refer to Step B2). As a result of such an operation, the insertion of the pause frame period is discontinued at the point of time when the polarity bias count value Nb becomes "0". At this discontinuation point of time, the polarity bias at the power supply OFF instructing point of time t1 is canceled by the polarity bias generated after this point of time t1, and a temporal integrated value of the data voltage held in each pixel formation portion 10 from the point of time t=0 when the power supply is turned on until the discontinuation point of time, that is, a temporal integrated value of the applied voltage to the liquid crystal layer becomes substantially "0".

When the polarity bias is canceled as described above, the off-sequence for discharge is thereafter started (refer to Steps B2 and B3). When this off-sequence is ended, the power supply of the liquid-crystal display device 100 is turned off.

Figure 8:
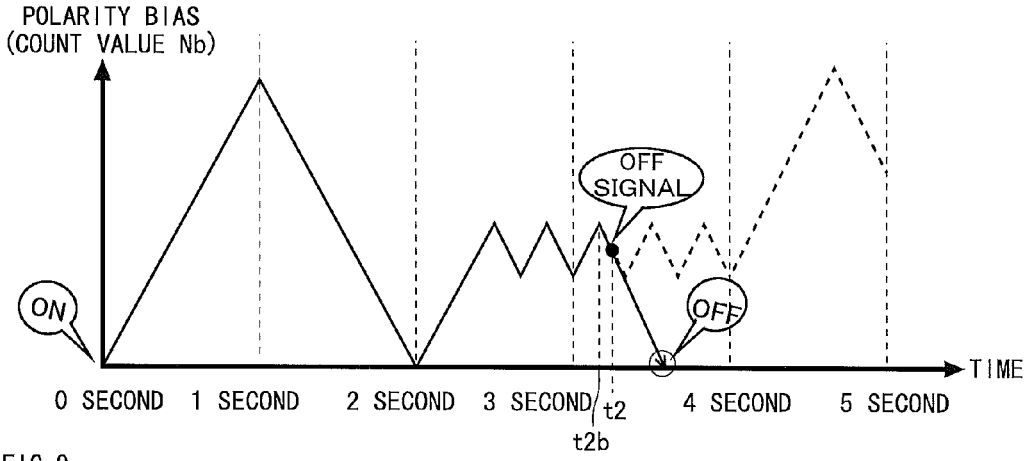
FIG. 8 is a timing chart showing a fourth operation example in the above-described first embodiment.

FIG. 8 is a timing chart showing the fourth operation example in this embodiment. In this operation example, in a similar way to the third operation example, the first refreshment is performed immediately after the power supply is turned on, and the periodical refreshment is performed at the point of time t=1 and the point of time t=2. Thereafter, the forced refreshment is performed three times, and the periodical refreshment is performed at the point of time t3. After the point of time t=3, the forced refreshment is performed at the point of time t2*b*, and the OFF signal Soff instructing OFF of the power supply is inputted from the host 90 at the subsequent point of time t2.

As shown in FIG. 8, the polarity bias count value Nb at this power supply OFF instructing point of time t2, is smaller than the immediately previous refreshing polarity bias count value Nbp (polarity bias count value Nb at the point of time t2*b*). Therefore, it is determined that the polarity bias is in the decreasing direction at the power supply OFF instructing point of time t2. As a result, after the power supply OFF instructing point of time t2, the insertion of the pause frame period is repeated with the refresh frame period being not inserted (refer to Step B1), and the polarity bias count value Nb is decremented by "1" every time when one pause frame period is ended (refer to Step B2). As a result of such an operation, the insertion of the pause frame period is discontinued at the point of time when the polarity bias count value Nb becomes "0". At this discontinuation point of time, the polarity bias at the power supply OFF instructing point of time t2 is canceled by the polarity bias generated after this point of time t2, and the temporal integrated value of the data voltage held in each pixel formation portion 10 from the point of time t=0 when the power supply is turned on until the discontinuation point of time, that is, the temporal integrated value of the applied voltage to the liquid crystal layer becomes substantially "0".

When the polarity bias is canceled as described above, then in a similar way to the third operation example, the power supply of the liquid-crystal display device 100 is turned off after being subjected to the off-sequence for discharge (refer to Steps B2, B3).

Figure 9:
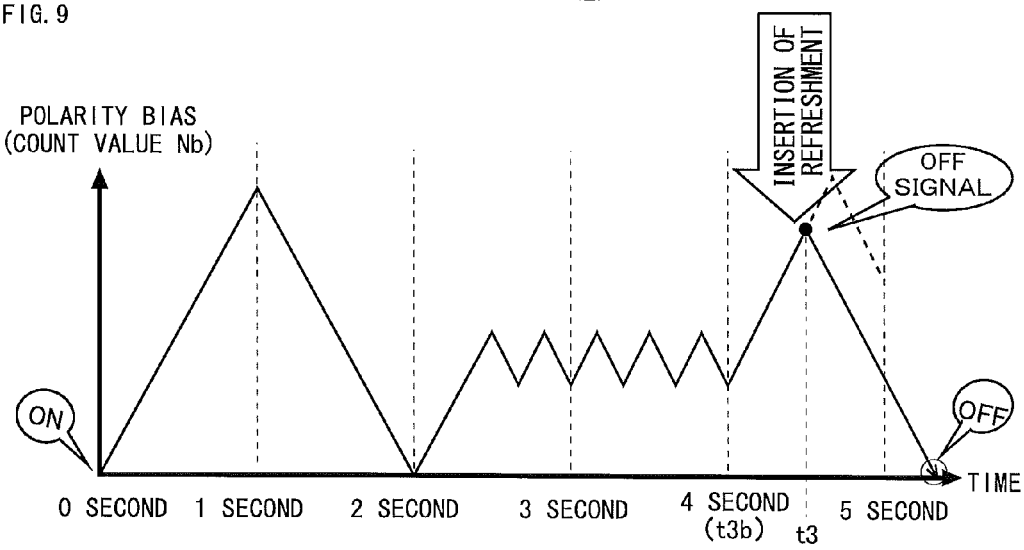
FIG. 9 is a timing chart showing a fifth operation example in the above-described first embodiment.

FIG. 9 is a timing chart showing the fifth operation example in this embodiment. In this operation example, an operation in the period of t=0 to 3 is similar to that in the fourth operation example (refer to FIG. 8), the forced refreshment is performed five times after the point of time t=3 (=t3*b*), the periodical refreshment is performed at the point of time t=4, and the OFF signal Soff instructing OFF of the power supply is inputted from the host 90 at the subsequent point of time t3.

As shown in FIG. 9, the polarity bias count value Nb at this power supply OFF instructing point of time t3, is larger than the immediately previous refreshing polarity bias count value Nbp (polarity bias count value Nb at the point of time t=4=t3*b*). Therefore, it is determined that the polarity bias is in the increasing direction at the power supply OFF instructing point of time t3. As a result, at the power supply OFF instructing point of time t3, the refresh frame period is started (refer to Step B1). The polarity of the data voltage held in each pixel formation portion 10 is reversed in this refresh frame period. Thereafter, the insertion of the pause frame period is repeated, and the polarity bias count value Nb is decremented by "1" every time when one pause frame period is ended (refer to Step B2). As a result of such an operation, the insertion of the pause frame period is discontinued at the point of time when the polarity bias count value Nb becomes "0". At this discontinuation point of time, the polarity bias at the power supply OFF instructing point of time t3 is canceled by the polarity bias generated after this point of time t3, and the temporal integrated value of the data voltage held in each pixel formation portion 10 from the point of time t=0 when the power supply is turned on until the discontinuation point of time, that is, the temporal integrated value of the applied voltage to the liquid crystal layer becomes substantially "0".

When the polarity bias is canceled as described above, then in a similar way to the third and fourth operation examples, the power supply of the liquid-crystal display device 100 is turned off after being subjected to the off-sequence for discharge (refer to Steps B2, B3).

1.5 Effects

In accordance with the above-described first embodiment, when the OFF signal Soff instructing OFF of the power supply is inputted, the moving direction of the polarity bias at the point of time when the OFF signal Soff is inputted (that is, the power supply OFF instructing point of time) is determined. As a result of this determination, in the case where the polarity bias is in the increasing direction, the polarity (polarity of the data voltage held in each pixel formation portion 10) of the applied voltage to the liquid crystal layer is reversed by the insertion of the refresh frame period, and the insertion of the pause frame period is thereafter started, and in the case where the polarity bias is in the decreasing direction, the insertion of the pause frame period is started without the refresh frame period being inserted. Then, in each of the above-described cases, the polarity bias count value Nb is decremented by "1" every time when the pause frame period is inserted, and the insertion of the pause frame period is discontinued at the point of time when the polarity bias count value Nb becomes "0". At this discontinuation point of time, the polarity bias at the power supply OFF instructing point of time is canceled by the above-described operation (control of the drive unit 300) after this power supply OFF instructing point of time, and the temporal integrated value of the applied voltage to the liquid crystal layer from the point of time t=0 when the power supply is turned on until the discontinuation point of time becomes substantially "0".

In such a manner as described above, the polarity bias of the applied voltage to the liquid crystal layer is resolved, whereby the charge storage owing to the uneven distribution of the impurity ions in the liquid crystal layer is resolved. Moreover, the off-sequence for discharge is executed after the discontinuation point of time (point of time when the polarity bias count value Nb becomes "0") of the insertion of the pause frame period, and the power supply is thereafter turned off. Therefore, the stored charge in the pixel capacitance Cp of each pixel formation portion 10 is also discharged. Hence, at the point of time when the power supply is turned off, either of the stored charge owing to the uneven distribution of the impurity ions and the stored charge in the pixel capacitance is not present. Therefore, also in the liquid-crystal display device that performs the pause drive for the purpose of largely reducing the power consumption, and so on as in this embodiment, a problem such as the generation of the flicker does not occur when the power supply is thereafter turned on to turn the liquid-crystal display device to the operation state.

Note that, in the above-described configuration, the insertion of the pause frame period is discontinued at the point of time when the polarity bias count value Nb becomes "0"; however, at a point of time when the above-described polarity bias count value Nb becomes a value sufficiently approximate to "0" (that is, a value in which the already-mentioned charge bias is ignorable), it may be determined that the above-described polarity bias count value Nb is substantially "0", and the insertion of the pause frame period may be discontinued. Moreover, in place of the configuration in which the pause frame period is inserted until the polarity bias count value Nb becomes "0", the insertion of the pause frame period may be discontinued at a point of time when the polarity bias count value Nb becomes such a value approximate to "0", which corresponds to substantial resolution of the polarity bias of the applied voltage to the liquid crystal layer from a viewpoint that the polarity bias just needs to be substantially resolved. Furthermore, from a viewpoint that the polarity bias of the applied voltage to the liquid crystal layer just needs to be capable of being decreased so as to contribute to the solution of the problem such as the generation of the flicker, the insertion of the pause frame period may be discontinued at a point of time when the polarity bias count value Nb becomes such a value approximate to "0", which corresponds to such reduction of the polarity bias of the applied voltage to the liquid crystal layer.

2. Variant of First Embodiment

In the above-described first embodiment, the drive unit 300 is controlled so that the polarity (polarity of the applied voltage to the liquid crystal layer) of the data voltage held in each pixel formation portion 10 can be reversed every time when the refresh frame period is inserted. However, such a configuration is also conceivable, in which the drive unit 300 is controlled so that a refresh frame period while the polarity of the data voltage held in each pixel formation portion 10 is not reversed can be included. In this case, in place of the configuration of switching the counting direction of the polarity bias count value Nb every time when the refresh frame period appears, the polarity bias calculation circuit 23 just needs to have a configuration of switching the counting direction of the polarity bias count value Nb only when there appears the refresh frame period while the polarity of the data voltage held in each pixel formation portion 10 is reversed. If such a configuration is adopted, in a similar way to the above-described first embodiment, the polarity bias of the applied voltage to the liquid crystal layer is resolved by the above-described control for the drive unit 300 after the power supply OFF instructing point of time, and accordingly, similar effects to those of the above-described first embodiment are obtained.

Note that, in the above-described first embodiment, the In—Ga—Zn—O TFT is used as the switching element in each pixel formation portion 10, and accordingly, the off-leak current is extremely small. However, in a case of using a silicon-based TFT other than the In—Ga—Zn—O TFT as the switching element, an off-leak current of the switching element is large, and accordingly, it is also possible to omit the above-described off-sequence for discharge.

3. Second Embodiment

In the above-described first embodiment, by the bias movement determination circuit 24, the moving direction of the polarity bias is determined at the power supply OFF instructing point of time based on the comparison between the polarity bias count value Nb and the immediately previous refreshing polarity bias count value Nbp. However, if this embodiment is premised on such a configuration, in which the polarity of the data voltage held in each pixel formation portion is reversed without fail when the refreshment is performed irrespective of whether the refreshment is the periodical refreshment or the forced refreshment, the moving direction of the polarity bias can be determined based on whether the number of times of the refreshment performed until the power supply OFF instructing point of time is an odd number or an even number. An embodiment in which attention is paid to this point is described below as a second embodiment of the present invention.

Figure 10:
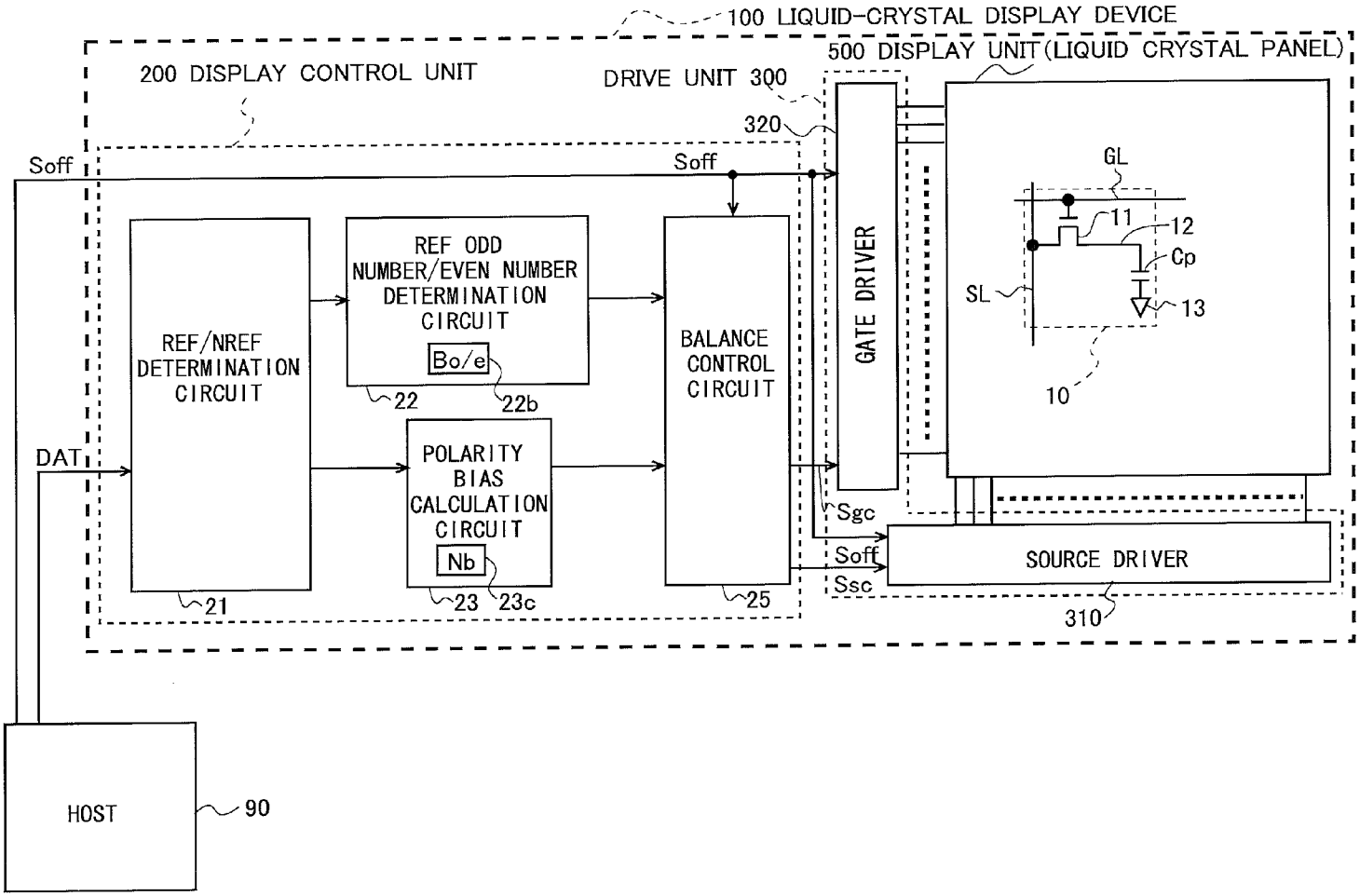
FIG. 10 is a block diagram showing an entire configuration of a liquid-crystal display device according to a second embodiment of the present invention.

FIG. 10 is a block diagram showing a configuration of a liquid-crystal display device 100 according to a second embodiment of the present invention. A configuration other than an internal configuration of the display control unit 200 in this liquid-crystal display device 100 is similar to that of the above-described first embodiment, and accordingly, the same reference numerals are assigned to the same portions, and a detailed description thereof is omitted.

As shown in FIG. 10, in a similar way to the first embodiment, the display control unit 200 in this embodiment receives the data DAT, which includes the input image data, from the host 90, and in response to this, generates and outputs the source driver control signal Ssc, the gate driver control signal Sgc, the common voltage signal and the like. Moreover, this display control unit 200 includes a REF/NREF determination circuit 21; a polarity bias calculation circuit 23; and a balance control circuit 25 in a similar way to the first embodiment; however, is different from that in the first embodiment in including a RFE odd number/even number determination circuit 22 in place of the bias movement determination circuit 24.

Based on the data DAT received from the host 90, the REF/NREF determination circuit 21 determines whether each frame period is a refresh period or a pause period, generates a REF/NREF signal indicating a result of the determination, and gives the generated REF/NREF signal to the REF odd number/even number determination circuit 22 and the polarity bias calculation circuit 23. Moreover, this REF/NREF signal is also given to the balance control circuit 25 through the polarity bias calculation circuit 23. This REF/NREF determination circuit 21 can be realized by a similar configuration to that of the REF/NREF determination circuit 21 in the first embodiment, and accordingly, a detailed description thereof is omitted.

Based on the above-described REF/NREF signal, the REF odd number/even number determination circuit 22 determines whether the number of times of the refreshment from the point of time when the power supply is turned on until the present point of time (that is, the number of the refresh frame periods included in the period) is an odd number or an even number, generates an odd number/even number signal indicating a result of the determination, and gives this to the balance control circuit 25. For the purpose of determining whether such a refreshment number of times as described above is an odd number or an even number, an odd number/even number bit register **22*b* that is a 1-bit register is included in the REF odd number/even number determination circuit 22. An odd number/even number bit value Bo/e that is a value of this odd number/even number bit register 22*b* is initialized to "0" at the point of time when the power supply is turned on, is changed to "1" at the starting point of time of the first refresh frame period immediately after such initialization, and subsequently, is alternately changed to "1" and "0" every time when the refresh frame period appears. This odd number/even number bit value Bo/e is outputted as a signal from the REF odd number/even number determination circuit 22, and is given to the balance control circuit 25. In this embodiment, this odd number/even number bit value Bo/e indicates the moving direction of the polarity bias, and accordingly, it can be said that a polarity bias movement determination unit is realized by the REF odd number/even number determination circuit 22**.

The polarity bias calculation circuit 23 includes a polarity bias counter **23*c* as a register for storing a value indicating a degree of the polarity bias at the present point of time, and is realized by a similar configuration to that of the polarity bias calculation circuit 23 in the first embodiment. A polarity bias count value Nb set in this immediately previous refreshing polarity bias counter 24*c* is outputted as a signal from the polarity bias calculation circuit 23, and is given to the balance control circuit 25**.

After the power supply is turned on, the balance control circuit 25 operates in a similar way to the balance control circuit 25 in the first embodiment until receiving the OFF signal Soff, which instructs OFF of the power supply, from the host 90. That is to say, the balance control circuit 25 controls the drive unit 300 so that the pause drive as shown in FIG. 4 or FIG. 6 can be performed.

Upon receiving the OFF signal Soff instructing OFF of the power supply from the host 90, the balance control circuit 25 controls the drive unit 300 so that the above-described polarity bias count value Nb at the power supply OFF instructing point of time can be sequentially decreased after that point of time and can become "0". Specifically, except for the following point, the balance control circuit 25 operates in a similar way to the balance control circuit 25 in the first embodiment (refer to (Step B1) to (Step B3), which are already mentioned).

The balance control circuit 25 in this embodiment determines whether the polarity bias is in the increasing direction or the decreasing direction based on the above-described odd number/even number bit value Bo/e, and is different from the balance control circuit 25 in the first embodiment in this point.

Also by this embodiment configured as described above, the drive unit 300 is controlled in a similar way to the first embodiment after the power supply OFF instructing point of time, the polarity bias at the power supply OFF instructing point of time is canceled by the control of the drive unit 300 after the power supply OFF instructing point of time, and the temporal integrated value of the applied voltage to the liquid crystal layer becomes substantially "0". Hence, also by this embodiment, similar effects to those of the first embodiment are obtained.

Note that, in the above-described configuration, the insertion of the pause frame period is discontinued at the point of time when the polarity bias count value Nb becomes "0"; however, at the point of time when the above-described polarity bias count value Nb becomes a value sufficiently approximate to "0" (that is, a value in which the already-mentioned charge bias is ignorable), it may be determined that the above-described polarity bias count value Nb is substantially "0", and the insertion of the pause frame period may be discontinued. Moreover, in place of the configuration in which the pause frame period is inserted until the polarity bias count value Nb becomes "0", the insertion of the pause frame period may be discontinued at the point of time when the polarity bias count value Nb becomes such a value approximate to "0", which corresponds to substantial resolution of the polarity bias of the applied voltage to the liquid crystal layer from a viewpoint that the polarity bias just needs to be substantially resolved. Furthermore, from a viewpoint that the polarity bias of the applied voltage to the liquid crystal layer just needs to be capable of being decreased so as to contribute to the solution of the problem such as the generation of the flicker, the insertion of the pause frame period may be discontinued at a point of time when the polarity bias count value Nb becomes such a value approximate to "0", which corresponds to such reduction of the polarity bias of the applied voltage to the liquid crystal layer.

4. Variants of Second Embodiment

Next, a description is made of variants of the second embodiment with reference to FIG. 11 to FIG. 14. These variants are those in which the configuration of the display control unit 200 in the above-described second embodiment is partially changed.

Figure 11:
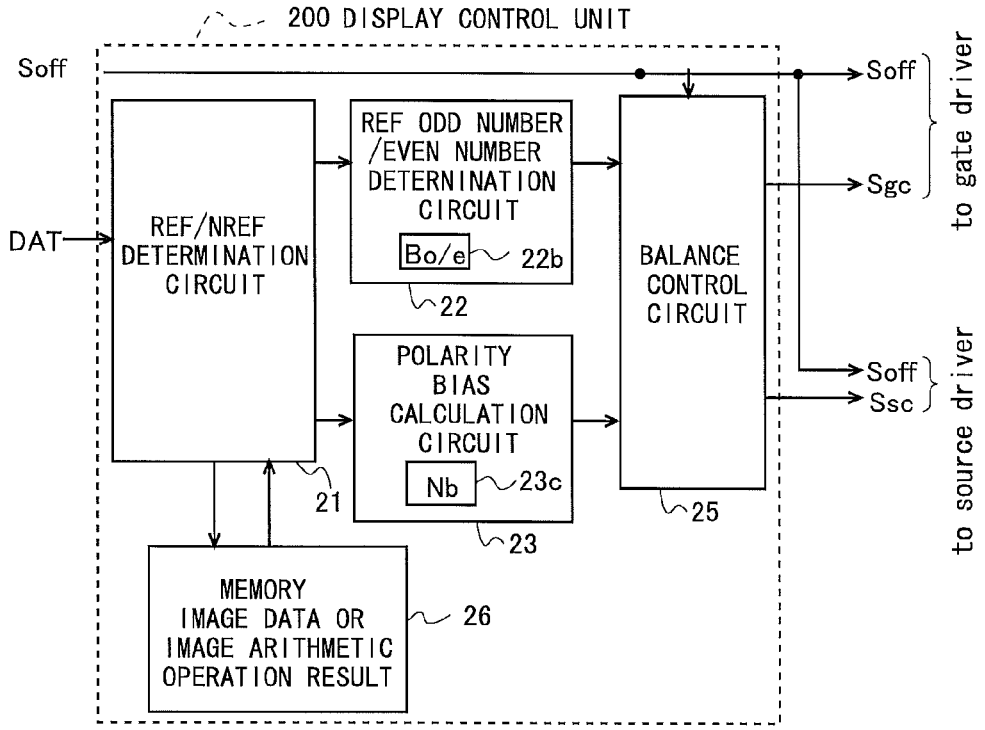
FIG. 11 is a diagram for explaining another configuration example for determining whether each frame period is a refresh period or a pause period in the liquid-crystal display device according to the present invention.

FIG. 11 is a diagram for explaining another configuration example for determining whether each frame period is the refresh period or the pause period in the liquid-crystal display device according to the present invention. In this configuration example, a memory 26 for storing image data or an image arithmetic operation result is provided in the display control unit 200. Based on the image data included in the data DAT sent from the host 90, the REF/NREF determination circuit 21 compares every frame with a previous frame, and determines whether or not the image is changed. Here, two continuous frames are referred to as a "preceding frame" and a "subsequent frame". The REF/NREF determination circuit 21 stores 1-frame image data of the preceding frame in advance in the memory 26, and upon receiving the data DAT, which includes image data of the subsequent frame, by the data DAT from the host 90, compares each pixel data of the preceding frame, which is based on the image data stored in the memory 26, and each pixel data of the subsequent frame, which is based on the image data included in the data DAT, with each other, and thereby determines whether the image is changed when the image moves from the preceding frame to the subsequent frame. As a result, in a case where it is determined that the image is changed, the subsequent frame period is determined to be the refresh period, and in a case where it is determined that the image is not changed, the subsequent frame period is determined to be the pause period, and such a result of the determination is outputted as a REF/NREF signal. Other configurations in the display control unit 200 and configurations other than the display control unit 200 are similar to those of the second embodiment shown in FIG. 10. Also by the liquid-crystal display device including such a configuration example as described above, similar effects to those of the second embodiment are obtained.

In the above-described configuration example, the image data of the preceding frame is stored in the memory 26 of the display control unit 200; however, in place of this, a result of a predetermined arithmetic operation for the image data of the preceding frame may be stored in the memory 26. In this case, the REF/NREF determination circuit 21 compares a result of the predetermined arithmetic operation for the image data of the subsequent frame with the result of the predetermined arithmetic operation for the preceding frame, which is stored in the memory 26, with each other. As a result, if both results of the predetermined arithmetic operations coincide with each other, the subsequent frame period is determined to be the pause period, and if both results of the predetermined arithmetic operations do not coincide with each other, the subsequent frame period is determined to be the refresh period. A determination result obtained as described above is outputted as the REF/NREF signal. Other configurations in the display control unit 200 and configurations other than the display control unit 200 are similar to those of the second embodiment shown in FIG. 10. Also by the liquid-crystal display device including such a configuration example as described above, similar effects to those of the second embodiment are obtained.

Figure 12:
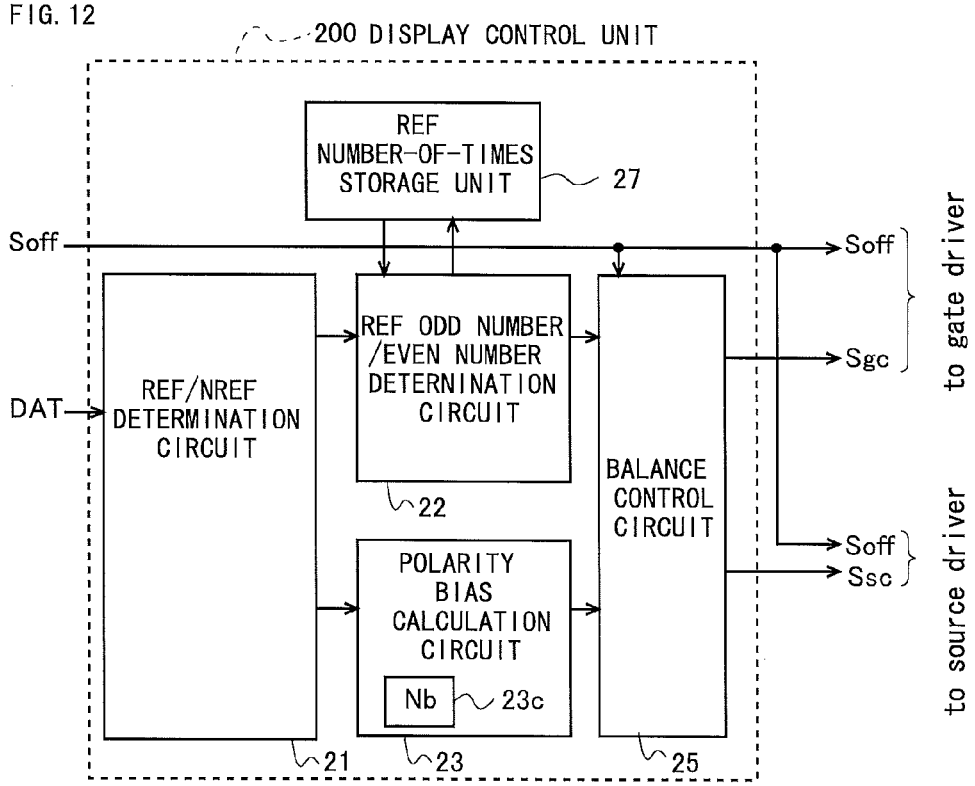
FIG. 12 is a diagram for explaining still another configuration example for determining a moving direction of the polarity bias in the liquid-crystal display device according to the present invention.

FIG. 12 is a diagram for explaining another configuration example for determining the moving direction of the polarity bias in the liquid-crystal display device according to the present invention. In this configuration example, the display control unit 200 includes a REF number-of-times storage unit 27 for storing the number of times of the refreshment. Other portions in the display control unit 200 and configurations other than the display control unit 200 are similar to those of the second embodiment shown in FIG. 10, and accordingly, the same reference numerals are assigned to the same or similar portions, and a detailed description thereof is omitted. In place of holding the information, which indicates whether the number of times of the refreshment is an odd number or an even number, by the odd number/even number bit register 22*b*, a REF odd number/even number determination circuit 22 in this configuration example stores in the REF number-of-times storage unit 27 a number of times of the refreshment from the point of time when the power supply is turned on, and sequentially updates the number of times of the refreshment, which is stored in the REF number-of-times storage unit 27, based on the REF/NREF signal coming from the REF/NREF determination circuit 21, generates an odd number/even number bit signal indicating whether the number of times of the refreshment, which is stored in the REF number-of-times storage unit 27, is an odd number or even number, and gives the generated odd number/even number bit signal to the balance control circuit 25. This odd number/even number bit signal indicates the moving direction of the polarity bias, and accordingly, in this configuration example, it can be said that the polarity bias movement determination unit is realized by the REF odd number/even number determination circuit 22.

Figure 13:
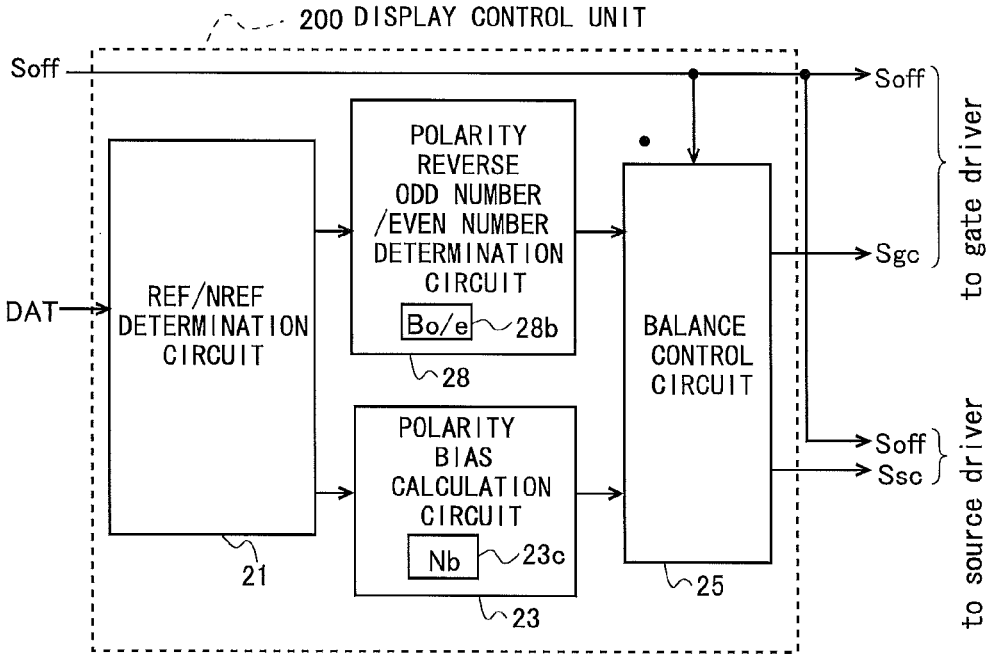
FIG. 13 is a diagram for explaining yet another configuration example for determining the moving direction of the polarity bias in the liquid-crystal display device according to the present invention.

FIG. 13 is a diagram for explaining another configuration example for determining the moving direction of the polarity bias in the liquid-crystal display device according to the present invention. In this configuration example, the display control unit 200 includes a polarity reverse odd number/even number determination circuit 28 in place of the REF odd number/even number determination circuit 22; however, other portions in the display control unit 200 and configurations other than the display control unit 200 are similar to those of the second embodiment shown in FIG. 10, and accordingly, the same reference numerals are assigned to the same or similar portions, and a detailed description thereof is omitted. The polarity reverse odd number/even number determination circuit 28 in this configuration example includes an odd number/even number bit register 28*b* indicating whether the number of times of the reverse of the polarity of the applied voltage to the liquid crystal layer is an odd number or an even number. Then, the polarity reverse odd number/even number determination circuit 28 receives a signal, which indicates whether or not to perform the refreshment of reversing the polarity of the data voltage in each pixel formation portion 10 in the next frame period, from the balance control circuit 25, and based on this signal and the REF/NREF signal coming from the REF/NREF determination circuit 21, sets in the odd number/even number bit register 28*b* a polarity reverse odd number/even number bit value Bo/e, which indicates whether the number of times of the reverse of the applied voltage to the liquid crystal layer from the point of time when the power supply is turned on is an odd number or an even number. This odd number/even number bit value Bo/e is outputted as a signal, and is given to the balance control circuit 25. This odd number/even number bit value Bo/e indicates the moving direction of the polarity bias, and accordingly, in this configuration example, it can be said that the polarity bias movement determination unit is realized by the polarity reverse odd number/even number determination circuit 28.

Figure 14:
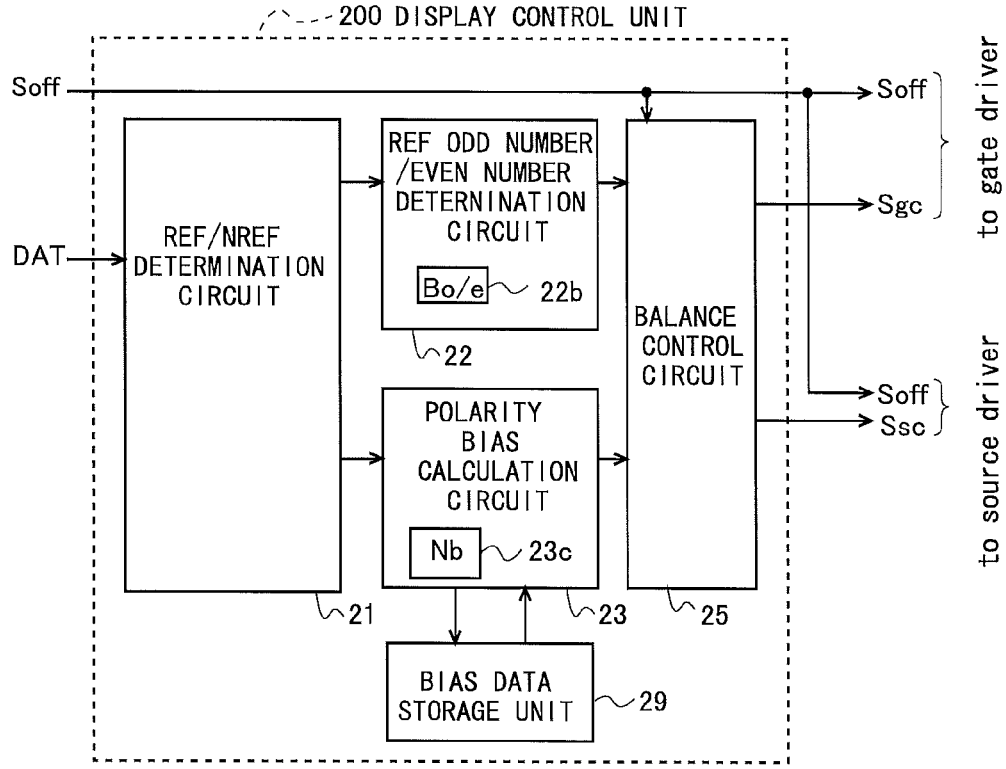
FIG. 14 is a diagram for explaining another configuration example for calculating a degree of the polarity bias in the liquid-crystal display device according to the present invention.

FIG. 14 is a diagram for explaining another configuration example for calculating a degree of the polarity bias in the liquid-crystal display device according to the present invention. In this example, the display control unit 200 includes a bias data storage unit 29 for storing polarity bias count values at a plurality of points of time in the most recent past. Other portions in the display control unit 200 and configurations other than the display control unit 200 are similar to those of the second embodiment shown in FIG. 10, and accordingly, the same reference numerals are assigned to the same or similar portions, and a detailed description thereof is omitted. The polarity bias calculation circuit 23 in this configuration example updates the polarity bias count values at the above-described plurality of points of time in the bias data storage unit 29 in a case of obtaining a new polarity bias count value Nb, obtains an average value (or representative value) of the polarity bias count values at the above-described plurality of points of time, and gives this average value to the balance control circuit 25 in place of the polarity bias count values Nb. Hence, in accordance with this configuration example, after the power supply OFF instructing point of time, the drive unit 300 is controlled based on the polarity bias count values at the above-described plurality of points of time. In such a way, even in a case where a sudden change and an unexpected change occurs in the polarity bias count value Nb, these changes are absorbed, and accordingly, the polarity bias at the power supply OFF instructing point of time can be stably resolved or decreased by the control for the drive unit 300 after the point of time. Note that, in place of the above-described average value, other value (for example, a median) that can be regarded to represent the polarity bias count values at the above-described plurality of point of times in the most recent past may be used.

5. Third Embodiment

In the above-described first and second embodiments, the moving direction of the polarity bias at the power supply OFF instructing point of time is determined, and based on the result of this determination, in the case where the polarity bias is in the increasing direction, the polarity of the data voltage in each pixel formation portion 10 is reversed (hence, the polarity of the applied voltage to the liquid crystal layer is reversed) by the insertion of the refresh frame period. In such a way, the polarity bias at the power supply OFF instructing point of time can be resolved (canceled) in a short time (refer to FIG. 4(B), FIG. 7 and the like). However, there is required the configuration (the bias movement determination circuit 24 in FIG. 3 or the REF odd number/even number determination circuit 22 in FIG. 10, and the like) for determining the moving direction of the polarity bias. Accordingly, in a case of making much of simplification of the configuration rather than the shortening of the time for revolving the polarity bias at the power supply OFF instructing point of time, preferably, the polarity bias is resolved or decreased after the power supply OFF instructing point of time without determining the moving direction of the polarity bias. Hereinbelow, an embodiment in which a configuration is simplified from this viewpoint is described as a third embodiment of the present invention.

5.1 Configuration and Summary of Operations

Figure 15:
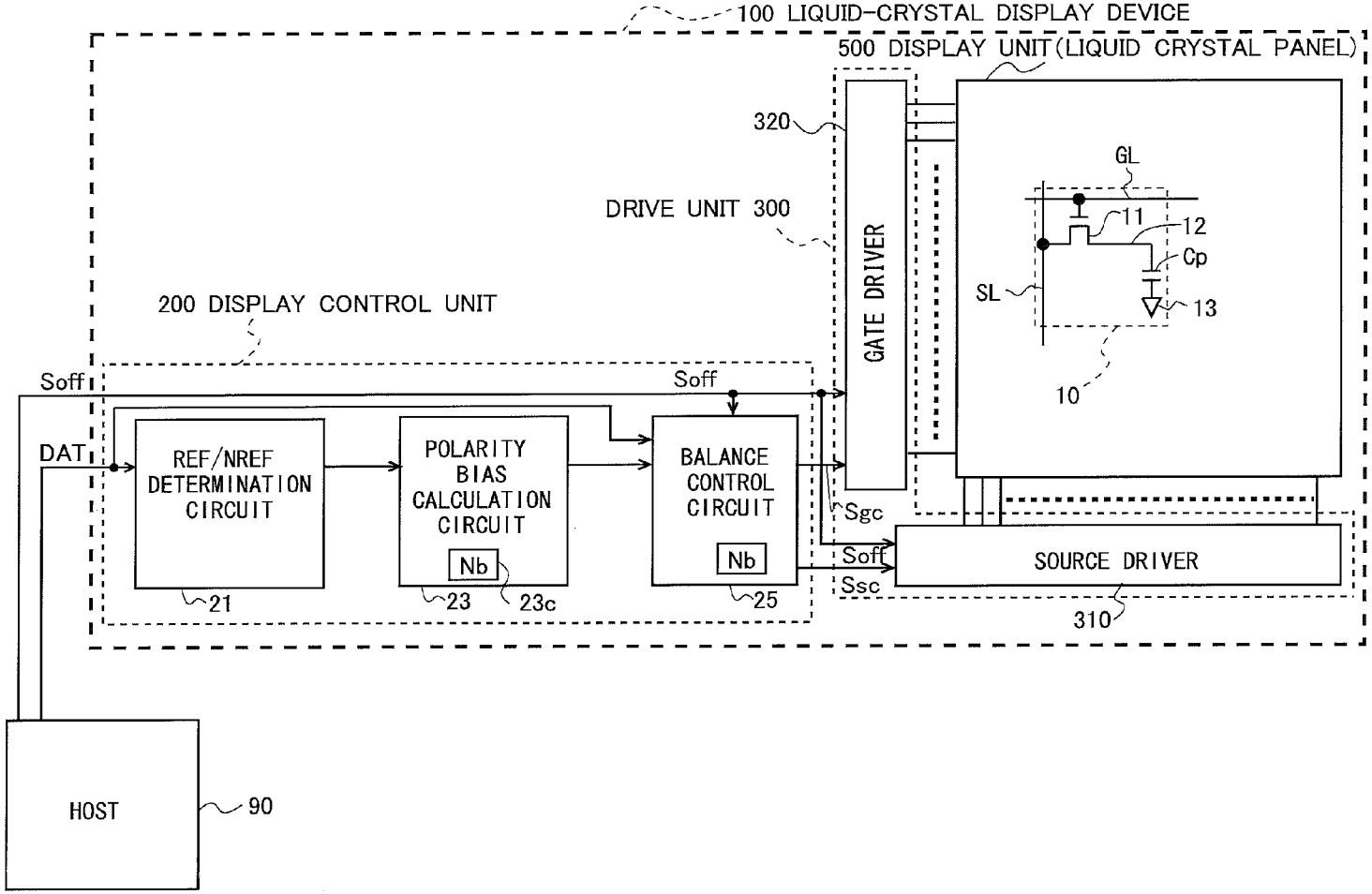
FIG. 15 is a block diagram showing an entire configuration of a liquid-crystal display device according to a third embodiment of the present invention.

FIG. 15 is a block diagram showing a configuration of a liquid-crystal display device 100 according to the third embodiment of the present invention. A configuration other than the internal configuration of the display control unit 200 in this liquid-crystal display device 100 is similar to that of the above-described first embodiment (refer to FIG. 3), and accordingly, the same reference numerals are assigned to the same or similar portions, and a detailed description thereof is omitted.

As shown in FIG. 15, in a similar way to the first embodiment, the display control unit 200 in this embodiment receives the data DAT, which includes the input image data, from the host 90, and in response to this, generates and outputs the source driver control signal Ssc, the gate driver control signal Sgc, the common voltage signal and the like. Moreover, this display control unit 200 includes a REF/NREF determination circuit 21; a polarity bias calculation circuit 23; and a balance control circuit 25 in a similar way to the first embodiment; however, does not include a constituent equivalent to the bias movement determination circuit 24.

Based on the data DAT received from the host 90, the REF/NREF determination circuit 21 determines whether each frame period is the refresh period or the pause period, generates a REF/NREF signal indicating a result of the determination, and gives the generated REF/NREF signal to the polarity bias calculation circuit 23. Moreover, this REF/NREF is also given to the balance control circuit 25 through the polarity bias calculation circuit 23. This REF/NREF determination circuit 21 can be realized by a similar configuration to that of the REF/NREF determination circuit 21 in the first embodiment, and accordingly, a detailed description thereof is omitted.

Also in this embodiment, the REF/NREF determination circuit 21 and the polarity bias calculation circuit 23 operate in a similar way to the first embodiment; however, the polarity bias count value Nb obtained in the polarity bias calculation circuit 23 is given to the balance control circuit 25.

Before the point of time when the OFF signal Soff instructing OFF of the power supply is inputted (that is, the power supply OFF instructing point of time), this balance control circuit 25 operates in a similar way to the balance control circuit 25 in the first embodiment; however, after the power supply OFF instructing point of time, operates in a different manner from that of the balance control circuit 25 in the first embodiment.

That is to say, upon receiving the OFF signal Soff instructing OFF of the power supply, the balance control circuit 25 in this embodiment starts an operation of "determining whether or not the polarity bias count value Nb is "0" every time of receiving the polarity bias count value Nb from the polarity bias calculation circuit 23 (hereinafter, this operation is referred to as a "zero determination operation") ". In this zero determination operation, during a period while it is determined that the polarity bias count value Nb from the polarity bias calculation circuit 23 is not "0", the balance control circuit 25 controls the drive unit 300 in a similar way to the case before the power supply OFF instructing point of time based on the data DAT coming from the host 90. Meanwhile, in this zero determination operation, when it is determined that the polarity bias count value Nb coming from the polarity bias calculation circuit 23 is "0", the balance control circuit 25 stops the control for the drive unit 300, which is based on the data DAT from the host 90, and executes an off-sequence similar to the off-sequence for discharge, which is used in the first embodiment and the like. When this off-sequence is ended, the power supply of the liquid-crystal display device 100 is turned off. Note that, in the above-described zero determination operation, it is determined whether or not the above-described polarity bias count value Nb is "0"; however, at the point of time when the above-described polarity count value Nb becomes a value sufficiently approximate to "0" (that is, a value in which the already-mentioned charge bias is ignorable), it may be determined that the above-described polarity bias count value Nb is substantially "0", and the off-sequence for discharge may be started.

5.2 Operation Example

Figure 16:
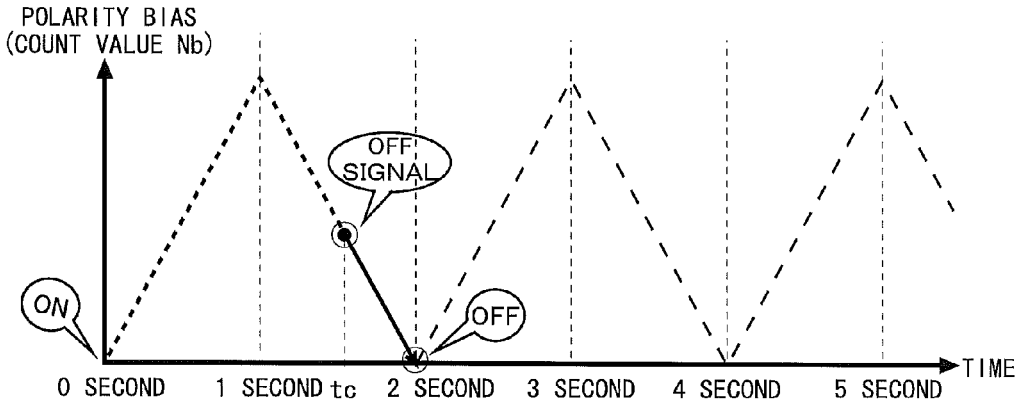
FIG. 16 is timing chart for explaining a first operation example in the above-described third embodiment.
Figure 17:
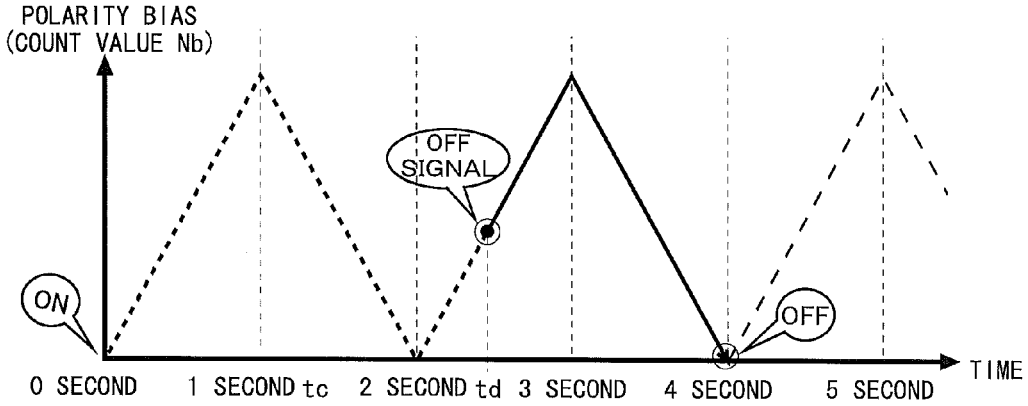
FIG. 17 is timing chart for explaining a second operation example in the above-described third embodiment.

FIG. 16 is a timing chart showing a first operation example in this embodiment, and FIG. 17 is a timing chart showing a second operation example in this embodiment. In these operation examples, in a similar way to the first and second operation examples in the above-described first embodiment, the periodical refreshment is performed once a second with the forced refreshment being not inserted, and every time when the refreshment is performed, the polarity of the data voltage in each pixel formation portion 10 is reversed (refer to FIG. 1, FIG. 4 and FIG. 5).

As shown in FIG. 16, in the first operation example in this embodiment, at a point of time tc in a period of t=1 to 2 (that is, a period from a point of time when one second elapses after the power supply is turned on until a point of time when two seconds elapse after the power supply is turned on), the OFF signal Soff instructing OFF of the power supply is inputted from the host 90. Hence, at this power supply OFF instructing point of time tc, the above-described zero determination operation is started. In this zero determination operation, during a period while it is determined that the polarity bias count value Nb from the polarity bias calculation circuit 23 is not "0", the drive unit 300 is controlled based on the data DAT coming from the host 90 in a similar way to the case before the power supply OFF instructing point of time tc, and the display unit 500 is driven by the drive unit 300.

In this first operation example, the polarity bias count value Nb coming from the polarity bias calculation circuit 23 is linearly decreased as shown by a solid line in FIG. 16 after the power supply OFF instructing point of time, and is determined to be "0" at the point of time t=2 by the above-described zero determination operation. Hence, at the point of time t=2, the above-described zero determination operation is ended, whereby the control for the drive unit 300, which is based on the data DAT coming from the host 90, is also ended. At a point of time when this zero determination operation is ended, a state where the polarity bias is resolved (degree of polarity bias is "0") is brought.

When the polarity bias is resolved as described above, the off-sequence for discharge is started. When this off-sequence is ended, the power supply of the liquid-crystal display device 100 is turned off.

As shown in FIG. 17, in the second operation example in this embodiment, the OFF signal Soff instructing OFF of the power supply is inputted at a point of time td during the period of t=2 to 3. In such a way, the above-described zero determination operation is started.

In this second operation example, the polarity bias count value Nb coming from the polarity bias calculation circuit 23 is linearly increased as shown by a solid line in FIG. 17 after the power supply OFF instructing point of time td, and the periodical refreshment is performed at the point of time t=3. In such a way, the polarity of the data voltage in each pixel formation portion 10 is reversed, and the polarity bias count value Nb coming from the polarity bias calculation circuit 23 is linearly decreased after the point of time t=3. Thereafter, at the point of time t=4, the polarity bias count value Nb coming from the polarity bias calculation circuit 23 becomes "0". Hence, at the point of time t=4, the above-described zero determination operation is ended, whereby the control for the drive unit 300, which is based on the data DAT coming from the host 90, is also ended. At a point of time when this zero determination operation is ended, a state where the polarity bias is resolved is brought.

When the polarity bias is resolved as described above, the off-sequence for discharge is started. When this off-sequence is ended, the power supply of the liquid-crystal display device 100 is turned off.

The above-described first and second operation examples are premised on the pause drive that does not include the forced refreshment. However, even in the pause drive including the forced refreshment, there comes the point of time when the polarity bias count value Nb coming from the polarity bias calculation circuit 23 becomes "0" in the above-described zero determination operation started after the power supply OFF instructing point of time. Hence, this embodiment may have a configuration of performing the pause drive including the forced refreshment.

5.3 Effects

As described above, in this embodiment, when the OFF signal Soff instructing OFF of the power supply is inputted, the above-described zero determination operation is started, and based on the zero determination operation, the operation of the drive unit 300 is maintained with the power supply being not turned off until the polarity bias is resolved (while the polarity bias count value Nb is not "0", and when the polarity bias is resolved (when the polarity bias count value Nb becomes "0"), OFF of the power supply is permitted. Hence, in accordance with this embodiment, in a similar way to the first and second embodiments, also in the liquid-crystal display device that performs the pause drive for the purpose of reducing the power consumption, and so on, a problem such as the generation of the flicker does not occur when the power supply is thereafter turned on to turn the liquid-crystal display device to the operation state. Moreover, in accordance with this embodiment, the configuration for determining the moving direction of the polarity bias is not required, and accordingly, the problem can be resolved by a simpler configuration than in the first and second embodiments.

Note that, in place of the configuration of permitting OFF of the power supply (starting the off-sequence for discharge) at the point of time when the polarity bias count value Nb becomes "0", OFF of the power supply may be permitted at the point of time when the polarity bias count value Nb becomes such a value approximate to "0", which corresponds to substantial resolution of the polarity bias of the applied voltage to the liquid crystal layer from a viewpoint that the polarity bias just needs to be substantially resolved. Furthermore, from a viewpoint that the polarity bias of the applied voltage to the liquid crystal layer just needs to be capable of being decreased so as to contribute to the solution of the problem such as the generation of the flicker, OFF of the power supply may be permitted at a point of time when the polarity bias count value Nb becomes such a value approximate to "0", which corresponds to such reduction of the applied voltage to the liquid crystal layer.

6. Other Variants

The embodiments and the variants thereof in the present invention, which are described above, are premised on that the pause drive is performed; however, the present invention is not limited to this, and is also applicable to a liquid-crystal display device that performs usual drive in which the pause period does not appear. Even in such a liquid-crystal display device according to a usual drive method, the present invention is particularly effective in such a case of writing the data voltage into the pixel formation portions for a plurality of the frame periods without reversing the voltage. Moreover, in the embodiments and the variants thereof in the present invention, which are described above, the polarity bias count value Nb is used, whereby the degree of the polarity bias of the applied voltage to the liquid crystal layer is expressed by using one frame period as a unit; however, the unit indicating the degree of the polarity bias may be changed to another one. For example, the degree of the polarity bias may be expressed by a time measured by a timer, and in this case, a balance of the polarity of the applied voltage to the liquid crystal layer is managed by the timer. Furthermore, in the embodiments and the variants thereof in the present invention, which are described above, all of the display control unit 200 is realized by hardware; however, a part or all of the configurations in the display control unit 200 may be realized by software.

INDUSTRIAL APPLICABILITY

The present invention is utilized for the liquid-crystal display devices using the TFT, which has the channel layer composed of the oxide semiconductor, as the switching element of the pixel formation portion, and among them, is utilized particularly for the liquid-crystal display device that performs the pause drive.

DESCRIPTION OF REFERENCE CHARACTERS

10: PIXEL FORMATION PORTION
11: THIN FILM TRANSISTOR (TFT)
12: PIXEL ELECTRODE
13: COMMON ELECTRODE
21: REF/NREF DETERMINATION CIRCUIT
22: REF ODD NUMBER/EVEN NUMBER DETERMINATION CIRCUIT
**22*b***: ODD NUMBER/EVEN NUMBER BIT REGISTER
23: POLARITY BIAS CALCULATION CIRCUIT
**23*c***: POLARITY BIAS COUNTER
24: BIAS MOVEMENT DETERMINATION CIRCUIT
**24*c***: IMMEDIATELY PREVIOUS REFRESHING POLARITY BIAS COUNTER
25: BALANCE CONTROL CIRCUIT
26: MEMORY
27: REF NUMBER-OF-TIMES STORAGE UNIT
28: POLARITY REVERSE ODD NUMBER/EVEN NUMBER DETERMINATION CIRCUIT
29: BIAS DATA STORAGE UNIT
100: LIQUID-CRYSTAL DISPLAY DEVICE
200: DISPLAY CONTROL UNIT
300: DRIVE UNIT
310: SOURCE DRIVER
320: GATE DRIVER
500: DISPLAY UNIT
Cp: PIXEL CAPACITANCE
Soff: OFF SIGNAL

The invention claimed is:

1. A liquid-crystal display device that displays an image represented by input image data, by applying a voltage corresponding to the input image data, to a liquid crystal layer in a display, the liquid-crystal display device comprising:

a driver that applies the voltage to the liquid crystal layer, the voltage corresponding to the input image data; and a display controller that controls the driver; wherein the display includes a plurality of pixel formation portions that hold the voltage to be applied to the liquid crystal layer as a data voltage;

in a pause period of pausing writing of the data voltage into the plurality of pixel formation portions and upon receiving an OFF signal instructing OFF of a power supply of an entirety of the liquid-crystal display device, the display controller controls the driver so that a polarity bias of the voltage applied to the liquid crystal layer is reduced from a time when the OFF signal is input until the power supply is turned off;

the polarity bias of the voltage applied to the liquid crystal layer is a difference between a total sum of a time while a positive data voltage is held in one of the plurality of pixel formation portions and a total sum of a time while a negative data voltage is held in the one of the plurality of pixel formation portions; and the display controller includes:

a bias movement determiner that determines whether the polarity bias is in an increasing direction or in a decreasing direction at a point of time when the OFF signal is input; and a balance controller that controls the driver in a case where the bias movement determiner determines that the polarity bias is in the increasing direction, so that the polarity bias is reduced after performing polarity reverse refreshment of writing a data voltage into the plurality of pixel formation portions, the data voltage reversing the polarity of the applied voltage to the liquid crystal layer, and that controls the driver in a case where the bias movement determiner determines that the polarity bias is in the decreasing direction, so that the polarity bias is reduced without performing the polarity reverse refreshment.

2. The liquid-crystal display device according to claim 1, wherein the display controller further includes a polarity bias calculator that obtains a degree of the polarity bias of the voltage applied to the liquid crystal layer, and the polarity bias calculator obtains a difference between a first number of frames and a second number of frames as a polarity bias count value indicating the degree of the polarity bias, the first number of frames being the number of frame periods while a data voltage with a same polarity as a polarity of a data voltage written into the pixel formation portions immediately after a point of time when the power supply of the entirety of the liquid-crystal display device is turned on is held in the pixel formation portions, the second number of frames being the number of frame periods while a data voltage with a different polarity from the polarity of the data voltage written into the pixel formation portions immediately after the power supply is turned on is held in the pixel formation portions, and the bias movement determiner determines whether the polarity bias is in the increasing direction or the decreasing direction based on comparison between the polarity bias count value at the point of time when the OFF signal is input and the polarity bias count value in a frame period before the point of time when the OFF signal is input.

3. The liquid-crystal display device according to claim 1, wherein the bias movement determiner determines whether or not the polarity bias is in the increasing direction or the decreasing direction in response to whether the number of times of polarity reverse of the data voltage held in the pixel formation portions from the point of time when the power supply is turned on until the point of time when the OFF signal is input is an odd number or an even number.

4. The liquid-crystal display device according to claim 1, wherein, before the point of time when the OFF signal is input, the balance controller controls the driver so that the data voltage reversing the polarity of the applied voltage to the liquid crystal layer is written during a refresh period of writing the data voltage into the pixel formation portions, and the bias movement determiner determines whether the polarity bias is in the increasing direction or the decreasing direction in response to whether a total number of frame periods included in the refresh period from the point of time when the power supply is turned on until the point of time when the OFF signal is input is an odd number or an even number.

5. The liquid-crystal display device according to claim 2, wherein the display controller further includes a REF/NREF determiner that determines, with regard to each frame period, whether the frame period is a refresh period of writing the data voltage into the plurality of pixel formation portions or the pause period of pausing the write of the data voltage into the plurality of pixel formation portions, and the balance controller:

controls, before the point of time when the OFF signal is input, the driver so that the refresh period of writing the data voltage into the plurality of pixel formation portions and the pause period of pausing the write of the data voltage into the plurality of pixel formation portions appears alternately based on a result of the determination by the REF/NREF determiner, and after the point of time when the OFF signal is input, in a case where the bias movement determiner determines that the polarity bias is in the increasing direction, controls the driver so that the pause period for reducing the polarity bias is inserted in response to the degree of the polarity bias at the point of time when the OFF signal is input after the polarity reverse refreshment is performed, and in a case where the bias movement determiner determines that the polarity bias is in the decreasing direction, controls the driver so that the pause period for reducing the polarity bias is inserted in response to the degree of the polarity bias at the point of time when the OFF signal is input without performing the polarity reverse refreshment.

6. The liquid-crystal display device according to claim 1, wherein the display controller further includes:

a polarity bias calculator that obtains a polarity bias of the voltage applied to the liquid crystal layer; wherein the balance controller that, upon receiving the OFF signal, starts a zero determination operation of continuously determining whether or not the polarity bias is substantially "0", maintains an operation of the driver without turning off the power supply while it is determined that the polarity bias is not "0" in the zero determination operation, and permits OFF of the power supply when the polarity bias is "0" in the zero determination operation.

7. The liquid-crystal display device according to claim 6, wherein the display includes a plurality of pixel formation portions composed so as to hold a voltage to be applied to the liquid crystal layer, as a data voltage, the display controller further includes a REF/NREF determiner that determines, with regard to each frame period, whether the frame period is a refresh period of writing the data voltage into the plurality of pixel formation portions or the pause period of pausing the write of the data voltage into the plurality of pixel formation portions, and the balance controller:

controls, before a point of time when the OFF signal is input, the driver so that the refresh period of writing the data voltage into the plurality of pixel formation portions and the pause period of pausing the write of the data voltage into the plurality of pixel formation portions appears alternately based on a result of the determination by the REF/NREF determiner, and after the point of time when the OFF signal is input, continues an operation of the driver, the driver being performed before the point of time when the Off signal is input, while it is determined that the polarity bias is not "0" by the zero determination operation.

8. The liquid-crystal display device according to claim 5, wherein the REF/NREF determiner detects presence of an image change by comparing image data for a previous frame period and image data for a subsequent frame with each other, and determines whether the subsequent frame period is the refresh period or the pause period in response to the presence of the image change.

9. The liquid-crystal display device according to claim 5, wherein the REF/NREF determiner detects presence of an image change by comparing a result of predetermined arithmetic operation processing using image data for a previous frame period and a result of the arithmetic operation processing using image data for a subsequent frame with each other, and determines whether the subsequent frame period is the refresh period or the pause period in response to the presence of the image change.

10. The liquid-crystal display device according to claim 5, wherein the REF/NREF determiner determines, with regard to each frame period, whether the frame period is the refresh period or the pause period by input information given from an outside.

11. The liquid-crystal display device according to claim 5, wherein, in a period while the input image data is not given from an outside, the REF/NREF determiner determines, with regard to each frame period, whether the frame period is the refresh period or the pause period so that the refresh period appears every predetermined time.

12. The liquid-crystal display device according to claim 1, further comprising:

data signal lines and scanning signal lines that are connected to the pixel formation portions and the driver, wherein each of the pixel formation portions includes:

a pixel capacitance that holds the data voltage; and a switching element having a control terminal connected to the scanning signal line, a first conduction terminal connected to the data signal line, and a second conduction terminal connected to the pixel capacitance, wherein the switching element includes a thin film transistor having a channel layer formed of an oxide semiconductor.

13. The liquid-crystal display device according to claim 12, wherein the oxide semiconductor contains indium, gallium, zinc and oxygen.

14. A method for driving a liquid-crystal display device that displays, on a display, an image represented by input image data, by applying a voltage corresponding to the input image data, to a liquid crystal layer in the display, the method comprising:

a driving step of applying the voltage to the liquid crystal layer, the voltage corresponding to the input image data; and in a pause period of pausing writing of a data voltage into a plurality of pixel formation portions, a polarity bias compensation step of, when an OFF signal instructing OFF of a power supply of the entirety of the liquid-crystal display device is input, controlling voltage application to the liquid crystal layer so that a polarity bias of the voltage applied to the liquid crystal layer until a point of time when the OFF signal is input can be reduced from a time when the OFF signal is input until the power supply is turned off; wherein the polarity bias of the voltage applied to the liquid crystal layer is a difference between a total sum of a time while a positive data voltage is held in one of the plurality of pixel formation portions and a total sum of a time while a negative data voltage is held in the one of the plurality of pixel formation portions; and the polarity bias compensation step includes:

a bias movement determination step that determines whether the polarity bias is in an increasing direction or in a decreasing direction at a point of time when the OFF signal is input; and a balance control step that controls a driver in a case where a bias movement determiner determines that the polarity bias is in the increasing direction, so that the polarity bias is reduced after performing polarity reverse refreshment of writing a data voltage into the plurality of pixel formation portions, the data voltage reversing the polarity of the applied voltage to the liquid crystal layer, and that controls the driver in a case where the bias movement determiner determines that the polarity bias is in the decreasing direction so that the polarity bias is reduced without performing the polarity reverse refreshment.

* * * * *